US010386132B2

(12) United States Patent
Iwasaki et al.

(10) Patent No.: US 10,386,132 B2
(45) Date of Patent: Aug. 20, 2019

(54) HEAT EXCHANGER

(71) Applicant: CALSONIC KANSEI CORPORATION, Saitama-shi, Saitama (JP)

(72) Inventors: Mitsuru Iwasaki, Saitama (JP); Junichiro Hara, Saitama (JP)

(73) Assignee: CALSONIC KANSEI CORPORATION, Sairama-Shi, Saitama (JP)

( * ) Notice: Subject to any disclaimer, the term of this patent is extended or adjusted under 35 U.S.C. 154(b) by 294 days.

(21) Appl. No.: 14/786,219

(22) PCT Filed: Apr. 17, 2014

(86) PCT No.: PCT/JP2014/060917
§ 371 (c)(1),
(2) Date: Oct. 22, 2015

(87) PCT Pub. No.: WO2014/175158
PCT Pub. Date: Oct. 30, 2014

(65) Prior Publication Data

US 2016/0069623 A1 Mar. 10, 2016

(30) Foreign Application Priority Data

Apr. 23, 2013 (JP) ..... 2013-090129
Feb. 27, 2014 (JP) ..... 2014-036638

(51) Int. Cl.
*F28F 1/20* (2006.01)
*F28F 13/12* (2006.01)
(Continued)

(52) U.S. Cl.
CPC ..... *F28F 13/12* (2013.01); *F02M 26/32* (2016.02); *F28D 7/1684* (2013.01);
(Continued)

(58) Field of Classification Search
CPC ..... F28F 2215/08; F28F 2215/10; F28F 2215/04; F28F 13/02; F28F 13/06;
(Continued)

(56) References Cited

U.S. PATENT DOCUMENTS 4,787,442 A * 11/1988 Esformes ..... F28F 1/12 165/151
6,578,627 B1 * 6/2003 Liu ..... F28F 1/32 165/109.1
(Continued)

FOREIGN PATENT DOCUMENTS

DE 19531383 A1 2/1997
DE 10303680 A1 8/2003
(Continued)

*Primary Examiner* — Jason N Thompson
(74) *Attorney, Agent, or Firm* — Foley & Lardner LLP

(57) ABSTRACT

A forward-tilting protruding piece leans forward toward an upstream side in a gas flow direction. A rearward-tilting protruding piece is disposed downstream of the forward-tilting protruding piece and leans rearward toward a downstream side in the gas flow direction. The forward-tilting protruding piece is in a shape of a four- or more-sided polygon including a base side in contact with a peripheral surface of the gas passage and a pair of left and right sides. The base side is oriented obliquely with respect to a direction perpendicular to the gas flow direction. The angle of one of the sides which is located on the upstream side in the gas flow direction with respect to the base side is larger than the angle of the other of the sides which is located on the downstream side in the gas flow direction with respect to the base side.

10 Claims, 27 Drawing Sheets

(51) Int. Cl.

| | |
|---|---|
| ***F28F 1/40*** | (2006.01) |
| ***F28D 7/16*** | (2006.01) |
| ***F28D 21/00*** | (2006.01) |
| ***F28F 1/02*** | (2006.01) |
| ***F02M 26/32*** | (2016.01) |
| ***F28F 3/02*** | (2006.01) |

(52) U.S. Cl.
CPC ..... *F28D 21/0003* (2013.01); *F28F 1/02* (2013.01); *F28F 1/40* (2013.01); *F28F 3/027* (2013.01); *F28F 2215/10* (2013.01)

(58) Field of Classification Search
CPC ..... F28F 13/12; F28F 13/125; F28F 3/025; F28F 3/027; F28F 3/08; F28F 1/40; F28F 1/02; F28D 1/0366; F28D 9/0062; F28D 9/0068; F28D 9/0025
See application file for complete search history.

(56) References Cited

U.S. PATENT DOCUMENTS

2002/0074105 A1* 6/2002 Hayashi ..... B60H 1/025 165/43
2004/0194936 A1* 10/2004 Torii ..... F28F 1/32 165/151
2004/0206484 A1 10/2004 Shimoya et al.
2005/0121181 A1* 6/2005 Szulman ..... F25J 3/04412 165/166
2007/0209786 A1 9/2007 Shimoya et al.
2009/0098432 A1* 4/2009 Rosenberg ..... F28F 13/12 429/444
2010/0095659 A1* 4/2010 Kuroyanagi ..... F01N 5/02 60/320
2010/0139631 A1* 6/2010 Geskes ..... F28F 1/40 123/568.12
2010/0302730 A1* 12/2010 Hernon ..... F28F 13/12 361/694
2014/0345578 A1* 11/2014 Yokoo ..... F28F 3/027 123/568.11

FOREIGN PATENT DOCUMENTS

| | | | | |
|---|---|---|---|---|
| DE | 102008046691 | A1 | 3/2010 | |
| EP | 1411315 | A1 * | 4/2004 | ..... F28D 7/16 |
| EP | 1982375 | B1 | 9/2011 | |
| JP | S60-060590 | U1 | 4/1985 | |
| JP | H02-160371 | A | 6/1990 | |
| JP | 2003-227691 | A | 8/2003 | |
| JP | 2003-279293 | A | 10/2003 | |
| JP | 2005-121348 | A | 5/2005 | |
| JP | 2008-232498 | A | 10/2008 | |
| JP | 2010-096456 | A | 4/2010 | |
| WO | WO 2007/009220 | A1 | 1/2007 | |
| WO | WO 2013/058267 | A1 | 4/2013 | |
| WO | WO 2013/080892 | A1 | 6/2013 | |

* cited by examiner (a)

(b)

(a)

(b)

(a)

(b)

(a)

(b)

(a)

(b)

(a)

(b)

HEAT EXCHANGER

TECHNICAL FIELD

The present invention relates to a heat exchanger and particularly to a heat exchanger in which gas passages for gas to flow and liquid passages for liquid to flow are stacked.

BACKGROUND ART

Patent Literature 1 discloses a heat exchanger in which gas passages for gas to flow and liquid passages for liquid to flow are stacked. As shown in FIG. 25, an exhaust-gas heat exchanging device 100 disclosed in Patent Literature 1 includes an exterior case 101, a plurality of tubes 110 housed inside the exterior case 101, and a pair of tanks 120, 121 disposed at the opposite ends of the plurality of tubes 110.

The exterior case 101 is provided with a cooling-water inlet 102 and a cooling-water outlet 103 for cooling water (cooling fluid). Inside exterior case 101, cooling water passages 104 are formed of the gaps between the adjacent tubes 110 and the like.

The opposite ends of all the tubes 20 are open to the inside of the pair of tanks 120, 121. One of the tanks, namely, the tank 120, is provided with an exhaust-gas inlet portion 120a while the other tank 121 is provided with an exhaust-gas outlet portion 121a.

The tubes 110 are stacked on top of one another. As shown in FIG. 26, each tube 110 is formed of two flat members 110a, 110b. An exhaust gas passage 111 is formed inside each tube 110. A fin 112 is disposed in the exhaust gas passage 111.

As shown in FIG. 27, the fin 112 is formed in a rectangular wave shape when viewed from the upstream side in the exhaust-gas flow direction S. The fin 112 includes a plurality of protruding pieces 113 that are lanced at intervals in the exhaust-gas flow direction S. Each protruding piece 113 has a triangular shape and protrudes in such a way as to impede the flow of the exhaust gas inside the exhaust gas passage 111. The orientation angle of the protruding piece 113 is oblique to a direction perpendicular to the exhaust-gas flow direction S.

The exhaust gas from an internal combustion engine flows through the exhaust gas passage 111 inside each tube 110. The cooling water flows through each cooling water passage 104 inside the exterior case 101. The exhaust gas and the cooling water exchange heat with each other through the tube 110 and the fin 112. In this heat exchange, the protruding pieces 113 of the fin 112 disturb the flow of the exhaust gas, thereby promoting the heat exchange.

As shown in FIG. 28, the exhaust gas flowing through the exhaust gas passage 111 cannot flow straight due to each protruding piece 113, and a low pressure region is therefore formed immediately downstream of (behind) the protruding piece 113. As shown in Parts (a) and (b) of FIG. 29, the exhaust gas colliding with the protruding piece 113 flows over oblique sides 113a, 113b of the protruding piece 113 and comes around behind the protruding piece 113. Due to the triangular shape of the protruding piece 113 (the slopes by the oblique sides 113a, 113b), each of a first flow that flows over the oblique side 113a and a second flow that flows over the oblique side 113b is such that the flow rate is large on the upper side of the slope and the flow rate is small on the lower side of the slope. Rotating force is exerted on each of the first flow and the second flow when the flow with the above flow rate distribution is drawn into the low pressure region mentioned above. As a result, as shown in Part (c) of FIG. 29, the first flow and the second flow each become a vortex flow. Thus, two vortex flows are formed downstream of the protruding piece 113. These vortex flows flow while disturbing a boundary layer formed in the vicinity of the inner surface of the exhaust gas passage 111 (exhaust-gas stationary layer). Hence, the heat exchange rate is improved.

CITATION LIST

Patent Literature

Patent Literature 1: Japanese Patent Application Publication No. 2010-96456

SUMMARY OF INVENTION

Technical Problem

In the above exhaust-gas heat exchanging device 100, however, the protruding piece 113 is in a triangular shape and thus provides only a small region (area) for blocking the flow of the exhaust gas. Thus, the pressure at the low pressure region, which is formed immediately downstream of the protruding piece 113, is not sufficiently low. For this reason, the force that draws the first flow and the second flow into the low pressure region is small, so that only two small vortex flows are formed. Even when one of the first flow and the second flow is larger than the other and only one vortex flow is formed, only a weak vortex flow can be formed since the drawing force is weak. With a weak vortex flow, the flow of the exhaust gas cannot be sufficiently agitated and therefore cannot greatly promote the heat transfer.

An object of the present invention is to provide a heat exchanger which forms vortex flows that greatly promote the heat transfer and can therefore improve the heat exchange rate.

Solution to Problem

One aspect of the present invention provides a heat exchanger, in which a forward-tilting protruding piece and a rearward-tilting protruding piece are provided in a gas passage through which gas flows, the forward-tilting protruding piece being disposed at a forward tilt angle to lean forward toward an upstream side in a gas flow direction, the rearward-tilting protruding piece being disposed downstream of the forward-tilting protruding piece and disposed at a rearward tilt angle to lean rearward toward a downstream side in the gas flow direction, the forward-tilting protruding piece is in a shape of a four- or more-sided polygon including a base side in contact with a peripheral surface of the gas passage and a pair of left and right sides, the base side of the forward-tilting protruding piece is disposed at an orientation angle such that the base side is oriented obliquely with respect to a direction perpendicular to the gas flow direction, and an angle of one of the sides which is located on the upstream side of the forward-tilting protruding piece in the gas flow direction with respect to the base side is larger than an angle of the other of the sides which is located on the downstream side of the forward-tilting protruding piece in the gas flow direction with respect to the base side.

According to the above aspect, a strong lateral vortex flow formed by a gas flow that flows over a top side of the forward-tilting protruding piece is converted into a strong longitudinal vortex flow by a gas flow that flows around the other of the sides. The longitudinal vortex flow does not decay at an early stage unlike the lateral vortex flow but lasts long and its path is changed by the rearward-tilting protruding piece such that the longitudinal vortex flow is tipped up to an upper side. The longitudinal vortex flow after its path is changed flows while disturbing a boundary layer formed in the vicinity of a peripheral surface defining the gas passage (exhaust-gas stationary layer). Thus, the heat transfer is greatly promoted. Accordingly, the heat exchange rate is improved.

It is preferable that the other of the sides is longer than the one of the sides.

It is preferable that the top side of the forward-tilting protruding piece which is the farthest side from the base side is inclined with respect to the base side such that the one of the sides side of the top side is lower in a front view as viewed in the gas flow direction.

It is preferable that the gas passage is divided into a plurality of segments arranged in the gas flow direction and in the direction perpendicular to the gas flow direction by being formed in such an offset pattern as to repeat recesses and protrusions in the perpendicular direction and be staggered at a predetermined interval in the gas flow direction, and the forward-tilting protruding piece and the rearward-tilting protruding piece are provided for each of the segments.

It is preferable that the forward-tilting protruding pieces are each formed on a surface that is in proximate contact with a liquid passage through which liquid flows, and the forward-tilting protruding pieces in the segments adjacent in the direction perpendicular to the gas flow direction are situated in the same orientation.

It is preferable that the forward-tilting protruding pieces are each formed on a surface that is in proximate contact with a liquid passage through which liquid flows, and the forward-tilting protruding pieces in the segments adjacent in the gas flow direction are line-symmetric to each other with respect to the direction perpendicular to the gas flow direction.

It is preferable that the angle of the one of the sides with respect to the base side is equal to or larger than 90 degrees and the angle of the other of the sides with respect to the base side is equal to or smaller than 90 degrees.

It is preferable that the forward tilt angle of the forward-tilting protruding piece is 40 to 50 degrees with respect to the gas flow direction.

It is preferable that the orientation angle of the forward-tilting protruding piece is 35 to 60 degrees with respect to the direction perpendicular to the gas flow direction.

A corner between each side of the forward-tilting protruding piece and the top side of the forward-tilting protruding piece, which is the farthest side from the base side, may be in a circular shape.

It is preferable that the base side of the rearward-tilting protruding piece is located at the same position as the base side of the forward-tilting protruding piece in a front view as viewed in the gas flow direction.

It is preferable that the rearward-tilting protruding piece is in a shape of a four- or more-sided polygon including a base side in contact with the peripheral surface of the gas passage and a pair of left and right sides, and the base side of the forward-tilting protruding piece is provided in parallel to the base side of the rearward-tilting protruding piece.

It is preferable that a width of the forward-tilting protruding piece in the direction perpendicular to the gas flow direction is 50 to 75% of a width of the segment in the direction perpendicular to the gas flow direction.

It is preferable that a height of the forward-tilting protruding piece in another direction perpendicular to the gas flow direction is 33 to 42% of a height of the segment in this direction perpendicular to the gas flow direction.

It is preferable that a length of the other of the sides of the forward-tilting protruding piece in the gas flow direction is 15 to 28% of a length of the segment in the gas flow direction.

It is preferable that a minimum distance between the forward-tilting protruding piece and the rearward-tilting protruding piece is 36 to 65% of the length of the other of the sides of the forward-tilting protruding piece in the gas flow direction.

It is preferable that the location of the center of the base side of the forward-tilting protruding piece is provided within a range of 35 to 65% of the length of the segment in the gas flow direction.

It is preferable that the location of the center of the base side of the forward-tilting protruding piece is provided within a range of 25 to 70% of the width of the segment in the direction perpendicular to the gas flow direction.

It is preferable that the forward-tilting protruding piece overlaps the rearward-tilting protruding piece by 70% or more in a front view as viewed in the gas flow direction.

It is preferable that the height of the segment in the other direction perpendicular to the gas flow direction is 22 to 38% of the length of the segment in the gas flow direction.

It is preferable that the width of the segment in the direction perpendicular to the gas flow direction is 15 to 40% of the length of the segment in the gas flow direction.

It is preferable that the width of the segment in the direction perpendicular to the gas flow direction is 82 to 112% of the height of the segment in the other direction perpendicular to the gas flow direction.

It is preferable that each segment is disposed to be shifted from the other segments adjacent thereto in the gas flow direction by 30 to 70% of the width thereof.

It is preferable that the rearward-tilting protruding piece is point-symmetric to the forward-tilting protruding piece.

DESCRIPTION OF EMBODIMENTS

A heat exchanger according to an embodiment of the present invention will be described below with reference to drawings. Note that the same or similar portions will be denoted by the same or similar reference signs and detailed description thereof will be omitted. Also, the drawings are schematic, and the dimensional relationship, ratio, and the like may differ from the actual ones and may also not be identical between the drawings. Further, directional terms such as "upper," "lower," and "left and right" in the following description are defined for the sake of describing the positional relationship between different portions, and the position in which the device is actually mounted and the like are not limited to those defined by the above terms.

<Heat Exchanger>

Figure 1:
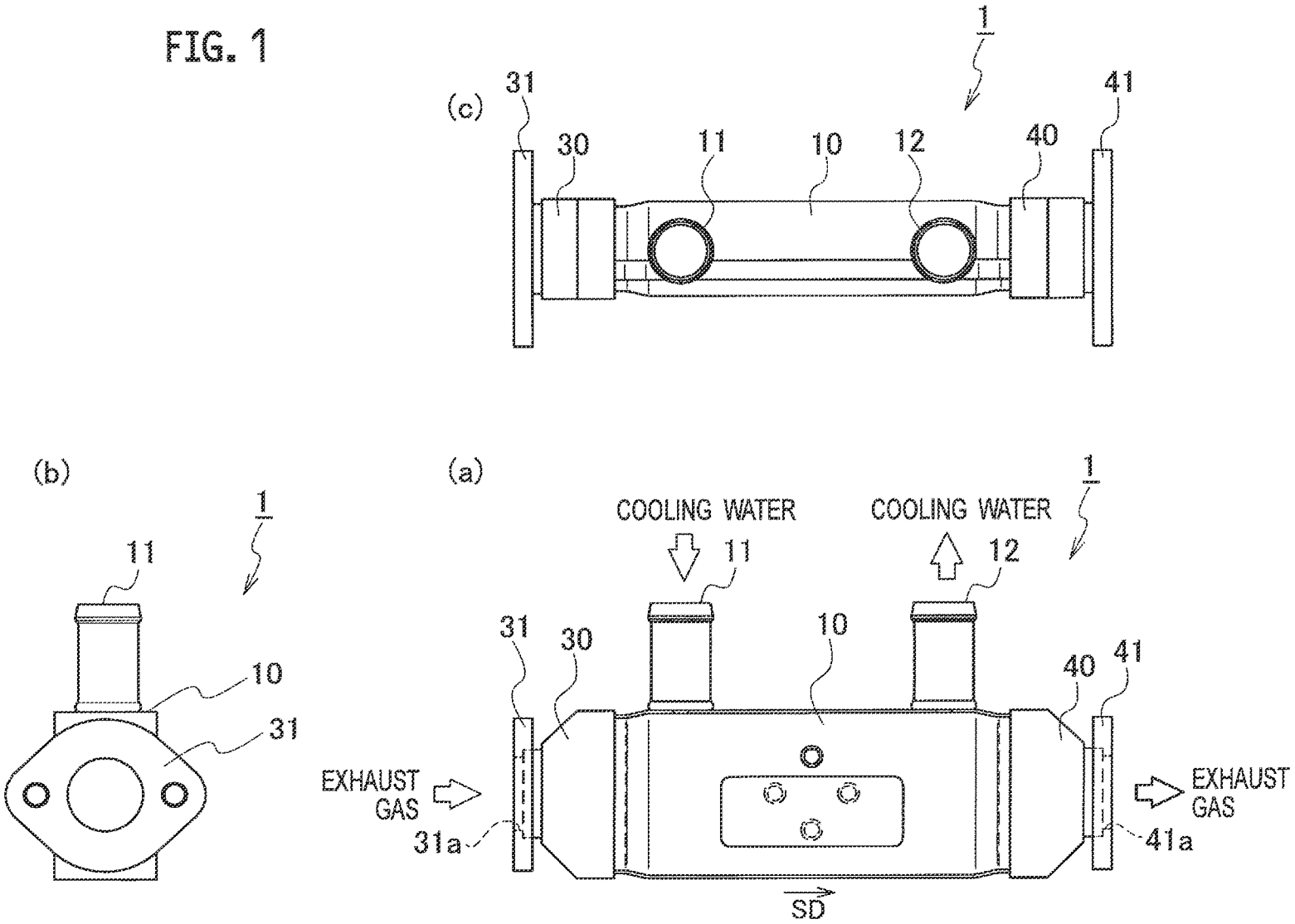
FIG. 1 shows a heat exchanger according to one embodiment of the present invention, and Part (a) is a side view of the heat exchanger, Part (b) is a front view of the heat exchanger, and Part (c) is a plan view of the heat exchanger.
Figure 2:
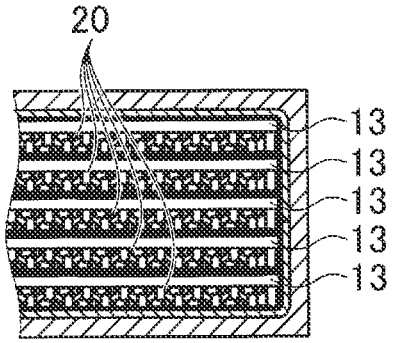
FIG. 2 shows part of the heat exchanger according to the one embodiment of the present invention, and Part (a) is a transverse cross-sectional view of part of the heat exchanger and Part (b) is a longitudinal cross-sectional view of part of the heat exchanger.
Figure 2:
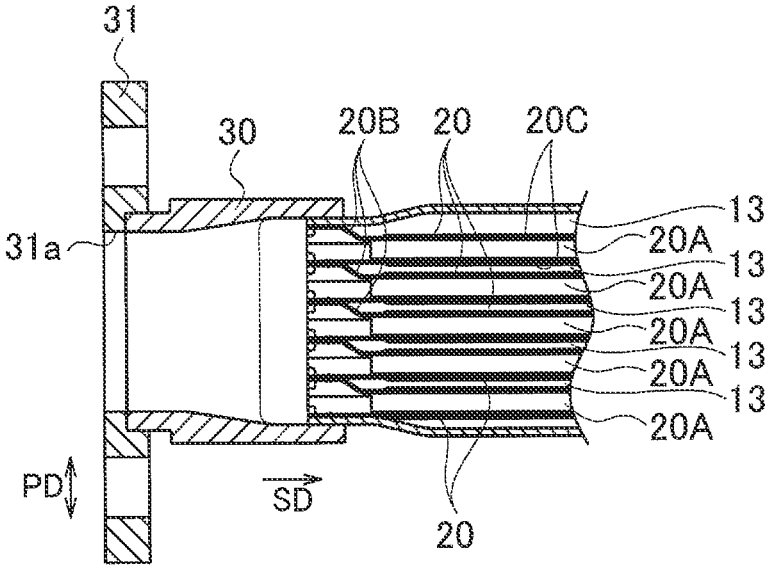

First, the structure of a heat exchanger 1 according to this embodiment will be described with reference to drawings. FIGS. 1 and 2 are views showing the heat exchanger 1 according to this embodiment. The heat exchanger 1 is, for example, an EGR cooler configured to cool the exhaust gas of an internal combustion engine circulated in an exhaust-gas recirculation system configured to circulate the exhaust gas into the intake air.

As shown in FIGS. 1 and 2, the heat exchanger 1 includes an exterior case 10, a plurality of tubes 20 housed inside the exterior case 10, and a pair of tanks 30, 40 disposed at the opposite ends of the plurality of tubes 20. These components are made of a material with excellent heat resistance and corrosion resistance (e.g. stainless steel). These components are fixed to each other by, for example, brazing their contact portions.

The exterior case 10 is provided with a cooling-water inlet 11 and a cooling-water outlet 12 for cooling water (cooling fluid). Cooling water passages 13 as fluid passages are formed outside the tubes 20 in the exterior case 10. Specifically, a cooling water passage 13 is formed in the gap between the adjacent tubes 20 and in the gap between each outermost tube 20 and the inner surface of the exterior case 10.

The tubes 20 are stacked in layers. Thus, exhaust gas passages 20A as gas passages through which the exhaust gas as gas flows and the cooling water passages 13 are provided alternately.

The opposite ends of each tube 20 are open to the inside of the pair of tanks 30, 40. An inlet header 31 in which an inlet 31*a* is formed for introducing the exhaust gas is mounted to one of the tanks, namely the tank 30. An outlet header 41 in which an outlet 41*a* is formed for discharging the exhaust gas is mounted to the other tank 40.

<Tube>

The structure of each tube 20 will be described with reference to drawings. FIGS. 3 to 6 are views showing the tube 20 according to this embodiment.

As shown in FIG. 2, each tube 20 is formed of two flat members 20C. Bulging portions 20B are formed at longitudinally opposite end portions of a given one of the flat members 20C. In the state where the tubes 20 are stacked, the bulging portions 20B are in contact with the adjacent tube 20. As a result, a gap that serves as the cooling water passage 13 is formed between the adjacent tubes 20.

Figure 3:
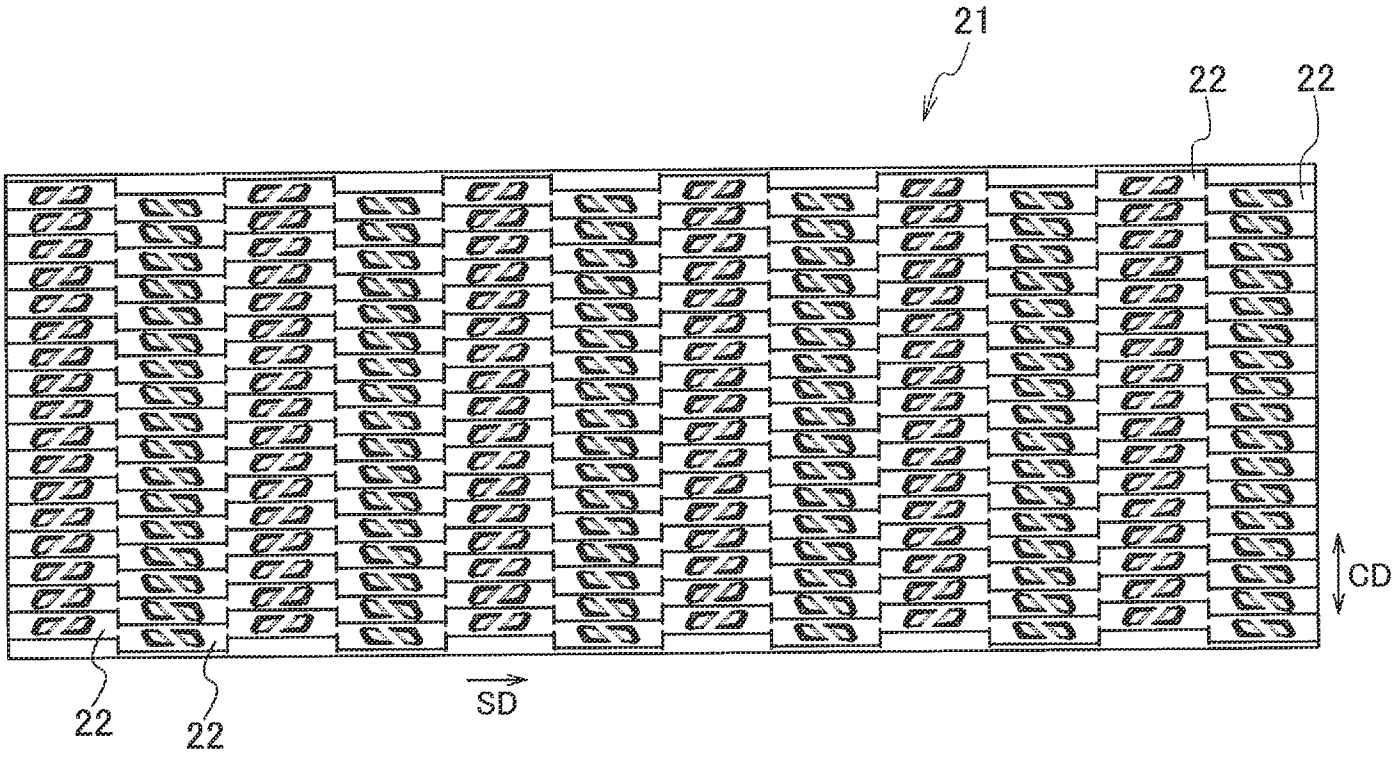
FIG. 3 is a plan view of a fin according to the one embodiment of the present invention.
Figure 4:
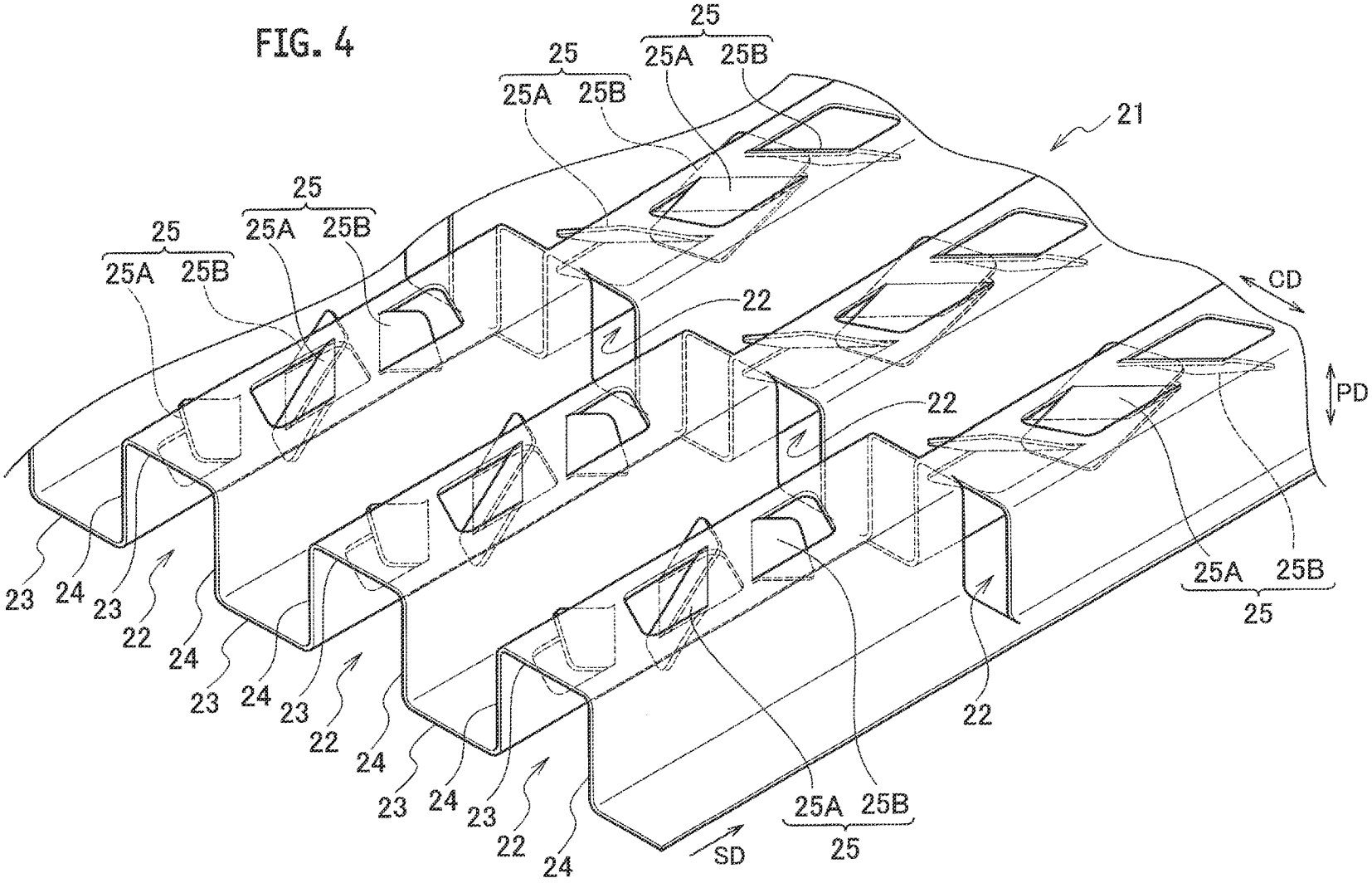
FIG. 4 is a perspective view of the fin according to the one embodiment of the present invention.
Figure 5:
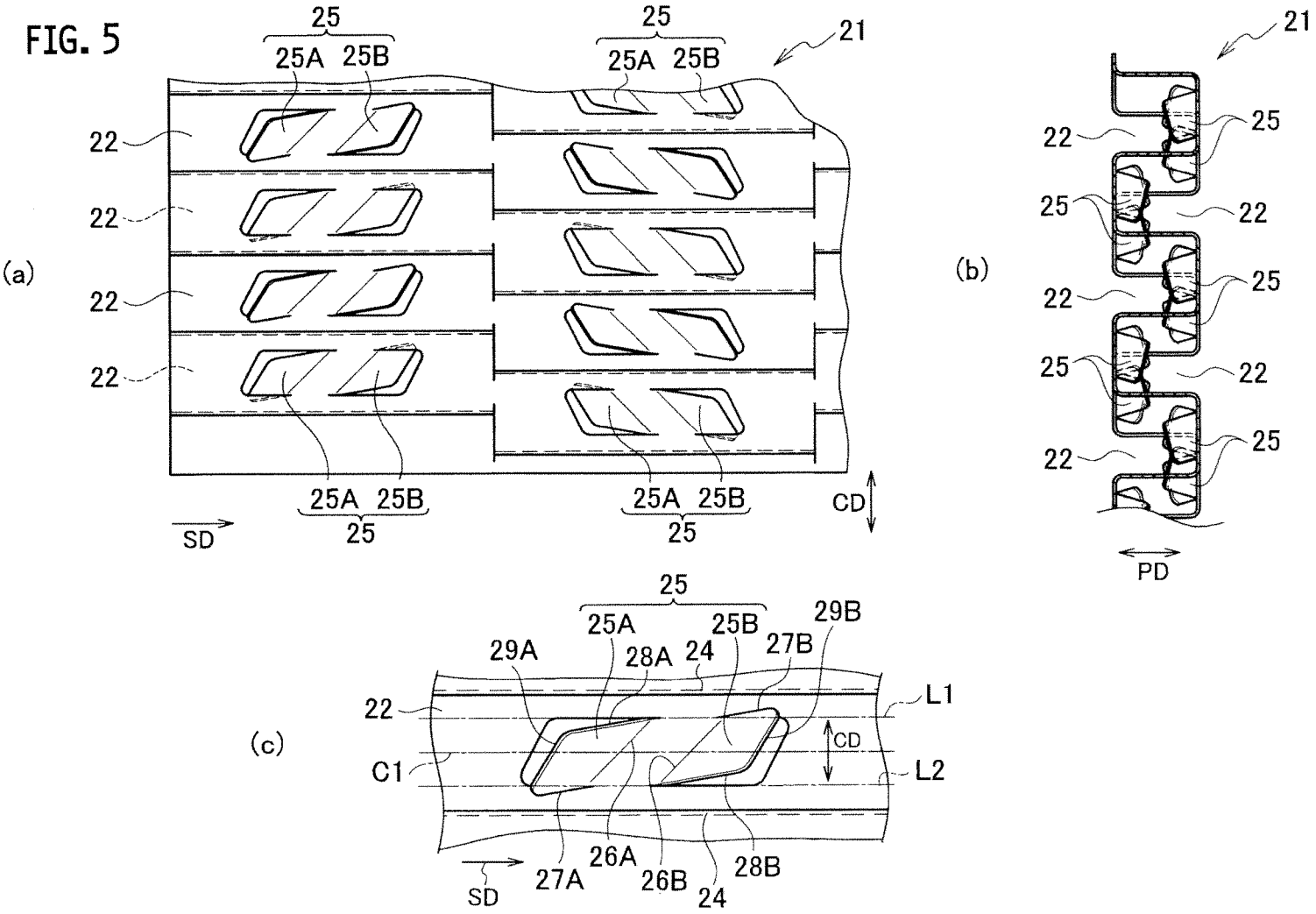
FIG. 5 shows the fin according to the one embodiment of the present invention, and Part (a) is an enlarged plan view of the fin, Part (b) is an enlarged front view of the fin, and Part (c) is a plan view of protruding pieces in one segment.
Figure 6:
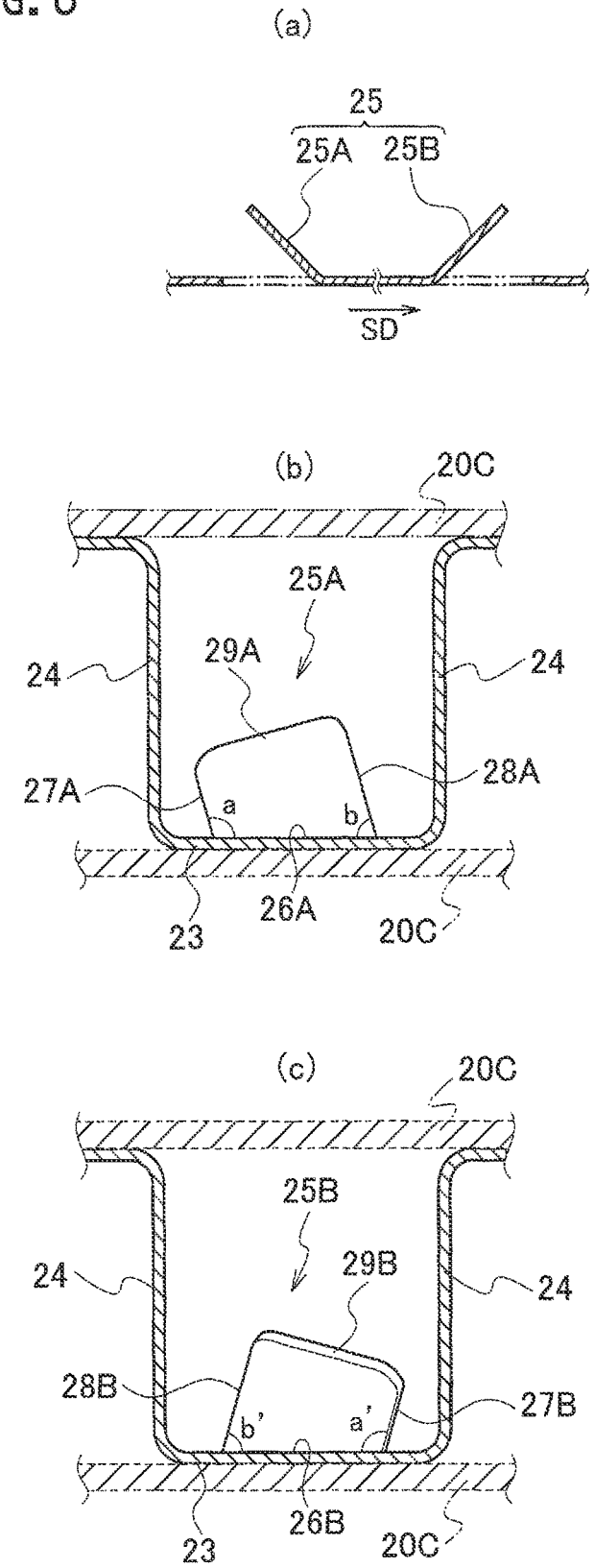
FIG. 6 shows the protruding pieces according to the one embodiment of the present invention, and Part (a) is a cross-sectional view of the protruding pieces, Part (b) is a front view of a forward-tilting protruding piece as viewed from the downstream side thereof, and Part (c) is a front view of a rearward-tilting protruding piece as viewed from the downstream side thereof.

The exhaust gas passages 20A are formed inside the tubes 20. A fin 21 is placed in each exhaust gas passage 20A. As shown in FIGS. 3 to 5, the exhaust gas passage 20A is divided into a plurality of segments 22 by the fin 21. As shown in FIGS. 4 and 6, the fin 21 is formed of a corrugated sheet in the shape of rectangular waves in a cross section thereof perpendicular to an exhaust-gas flow direction SD, in which horizontal walls 23 and vertical walls 24 are disposed alternately and continuously. The horizontal walls 23 are in tight contact with the inner surfaces of the flat members 20C of the tube 20 (i.e. the surfaces of flow passage walls defining the cooling water passages 13). The vertical walls 24 divide the exhaust gas passage 20A into the plurality of segments 22. As shown in FIGS. 3 and 4, the fin 21 has a shape in which a plurality of wavy patterns are arranged side by side in the exhaust-gas flow direction SD with their positions shifted (offset) in a direction CD perpendicular to the exhaust-gas flow direction SD and a tube stacking direction PD (hereinafter, also referred to as the perpendicular direction CD) at a predetermined interval in the exhaust-gas flow direction SD. In each of the wavy patterns, a plurality of recesses and protrusions in the tube stacking direction PD formed of the horizontal walls 23 and the vertical walls 24 are arranged side by side in the perpendicular direction CD. In other words, as shown in FIGS. 3 and 4, a plurality of segments 22 are arranged in the exhaust-gas flow direction SD and in the direction CD, perpendicular to the exhaust-gas flow direction SD and the tube stacking direction PD, by being formed in such an offset pattern as to repeat recesses and protrusions in the perpendicular direction CD and be staggered at a predetermined interval in the exhaust-gas flow direction SD.

Each segment 22 is defined by a plurality of inner surfaces extending in the exhaust-gas flow direction SD (four surfaces in total including one inner surface of the tube 20 and three inner surfaces of the fin 21). A plurality of protruding pieces 25 are formed on the horizontal wall 23 of each segment 22 away from each other in the exhaust-gas flow direction SD by lancing.

The protruding pieces 25 protrude in such a way as to impede the flow of the exhaust gas inside the exhaust gas passage 20A. Specifically, the protruding pieces 25 include a forward-tilting protruding piece 25A and a rearward-tilting protruding piece 25B. The forward-tilting protruding piece 25A is disposed at a forward tilt angle $\alpha 1$ to lean forward toward the upstream side in the exhaust-gas flow direction SD (a position in which the protruding piece is tilted with the tip end located upstream of the base side). The rearward-tilting protruding piece 25B is disposed downstream of the forward-tilting protruding piece 25A and disposed at a rearward tilt angle $\alpha 2$ to lean rearward toward the downstream side in the exhaust-gas flow direction SD (a position in which the protruding piece is tilted with the tip end located downstream of the base side). The forward tilt angle $\alpha 1$ is the angle of the forward-tilting protruding piece 25A with respect to the horizontal wall 23 in a cross section parallel to the exhaust-gas flow direction SD and perpendicular to the horizontal wall 23 (see FIG. 11, for example). Also, the rearward tilt angle $\alpha 2$ is the angle of the rearward-tilting protruding piece 25B with respect to the horizontal wall 23 in the cross section parallel to the exhaust-gas flow direction SD and perpendicular to the horizontal wall 23 (see FIG. 11, for example).

<Forward-Tilting Protruding Piece>

As shown in Part (b) of FIG. 6, the forward-tilting protruding piece 25A is formed in a trapezoidal shape including: a base side 26A located on a peripheral surface defining the exhaust gas passage 20A; a pair of left and right sides 27A, 28A; and a top side 29A which is the farthest side from the base side 26A.

The base side 26A is disposed at an orientation angle $\beta 1$ such that the base side 26A is oriented obliquely with respect to the perpendicular direction CD (to obliquely cross the perpendicular direction CD at the orientation angle $\beta 1$). The orientation angle $\beta 1$ is the angle of the base side 26A with respect to the perpendicular direction CD (see FIG. 11, for example). One of the sides, namely, the side 27A is located upstream of the other of the sides, namely, the side 28A in the exhaust-gas flow direction SD. The one of the sides 27A is shorter than the other of the sides 28A. In other words, the other of the sides 28A is longer than the one of the sides 27A.

As shown in Part (b) of FIG. 6, in a view of the forward-tilting protruding piece 25A from the downstream side in the exhaust-gas flow direction SD, an angle a of the one of the sides 27A with respect to the base side 26A (angle formed between the one of the sides 27A and the base side 26A) is larger than an angle b of the other of the sides 28A with respect to the base side 26A (angle formed between the other of the sides 28A and the base side 26A). Specifically, the angle a is set to be equal to or larger than 90 degrees while the angle b is set to be equal to or smaller than 90 degrees. The top side 29A is inclined with respect to the base side 26A such that the side 27A side of the top side 29A is lower in the front view as viewed from the downstream side in the exhaust-gas flow direction SD (see Part (b) of FIG. 6).

As shown in FIGS. 3 to 5, the forward-tilting protruding pieces 25A in the segments 22 adjacent in the perpendicular direction CD are situated in the same orientation. Moreover, the forward-tilting protruding pieces 25A in the segments 22 adjacent in the exhaust-gas flow direction SD are line-symmetric to each other with respect to the perpendicular direction CD. That is, the position, in the perpendicular direction CD, of the one of the sides 27A is the same between the segments 22 adjacent in the perpendicular direction CD and is plane-symmetric between the segments 22 adjacent in the exhaust-gas flow direction SD.

<Rearward-Tilting Protruding Piece>

The rearward-tilting protruding piece 25B is point-symmetric to the forward-tilting protruding piece 25A in a front view as viewed in the tube stacking direction PD. Specifically, as shown in Part (c) of FIG. 6, the rearward-tilting protruding piece 25B is formed in a trapezoidal shape including a base side 26B, a pair of left and right sides 27B, 28B, and a top side 29B.

As shown in Part (c) of FIG. 6, the base side 26B of the rearward-tilting protruding piece 25B is located at the same position as the base side 26A of the forward-tilting protruding piece 25A in a front view as viewed from the downstream side in the exhaust-gas flow direction SD. In other words, as shown in Part (c) of FIG. 5, one end of the base side 26B of the rearward-tilting protruding piece 25B and the other end of the base side 26A of the forward-tilting protruding piece 25A are disposed on a straight line L1 that is parallel to the exhaust-gas flow direction SD, while the other end of the base side 26B of the rearward-tilting protruding piece 25B and one end of the base side 26A of the forward-tilting protruding piece 25A are disposed on a straight line L2 that is parallel to the exhaust-gas flow direction SD. In this embodiment, the center (midpoint) of the base side 26B of the rearward-tilting protruding piece 25B and the center (midpoint) of the base side 26A of the forward-tilting protruding piece 25A are disposed on a center line C1 of the segment 22 in its widthwise direction (perpendicular direction CD). In this way, even if the fin 21 is placed back to front when the tube 20 is assembled, the dimensions of the gaps between the vertical walls 24 and the respective protruding pieces 25A, 25B (the size of the spaces through which the gas flow passes) remain the same and thus the strength of a gas flow S that flows around the side 28A, 28B remains the same as well. Hence, the degree of the performance can be maintained constant.

The base side 26B is disposed at an orientation angle β2 such that the base side 26B is oriented obliquely with respect to the perpendicular direction CD (to obliquely cross the perpendicular direction CD orientation angle β2). The base side 26B is provided in parallel to the base side 26A of the forward-tilting protruding piece 25A. The orientation angle β2 is the angle of the base side 26B with respect to the perpendicular direction CD (see FIG. 11, for example). One of the sides, namely, the side 27B is located downstream of the other of the sides, namely, the side 28B in the exhaust-gas flow direction SD. The one of the sides 27B is shorter than the other of the sides 28B. In other words, the other of the sides 28B is longer than the one of the sides 27B.

As shown in Part (c) of FIG. 6, in a view of the rearward-tilting protruding piece 25B from the downstream side in the exhaust-gas flow direction SD, an angle a' of the one of the sides 27B with respect to the base side 26B (angle formed between the one of the sides 27B and the base side 26B) is larger than an angle b' of the other of the sides 28B with respect to the base side 26B (angle formed between the other of the sides 28B and the base side 26B). Specifically, the angle a' is set to be equal to or larger than 90 degrees while the angle b' is set to be equal to or smaller than 90 degrees. The top side 29B is inclined with respect to the base side 26B such that the side 27B side of the top side 29B is lower in the front view as viewed from the downstream side in the exhaust-gas flow direction SD (or in the direction against the exhaust-gas flow direction SD) (see Part (c) of FIG. 6).

As shown in FIGS. 3 to 5, the rearward-tilting protruding pieces 25B in the segments 22 adjacent in the perpendicular direction CD are situated in the same orientation. Moreover, the rearward-tilting protruding pieces 25B in the segments 22 adjacent in the exhaust-gas flow direction SD are line-symmetric to each other with respect to the perpendicular direction CD. That is, the position, in the perpendicular direction CD, of the one of the sides 27B is the same between the segments 22 adjacent in the perpendicular direction CD and is plane-symmetric between the segments 22 adjacent in the exhaust-gas flow direction SD.

<Heat-Exchange Promoting Operation>

Operation of promoting the heat exchange in the heat exchanger 1 will be described based on FIGS. 7 to 9. Note that, in the description associated with FIGS. 7 to 9, the upper left segment 22 in FIG. 7 is referred to as "segment 22A," the lower left segment 22 in FIG. 7 is referred to as "segment 22B," the upper right segment 22 in FIG. 7 is referred to as "segment 22C," and the lower right segment 22 in FIG. 7 is referred to as "segment 22D."

In the heat exchanger 1, the exhaust gas discharged from the internal combustion engine flows through the exhaust gas passage 20A inside each tube 20. The cooling water flows through each cooling water passage 13 inside the exterior case 10. The exhaust gas and the cooling water exchange heat with each other through the tube 20 and the fin 21. In this heat exchange, the forward-tilting protruding pieces 25A and the rearward-tilting protruding pieces 25B of the fin 21 disturb the flow of the exhaust gas inside the exhaust gas passage 20A, thereby promoting the heat exchange.

Figure 7:
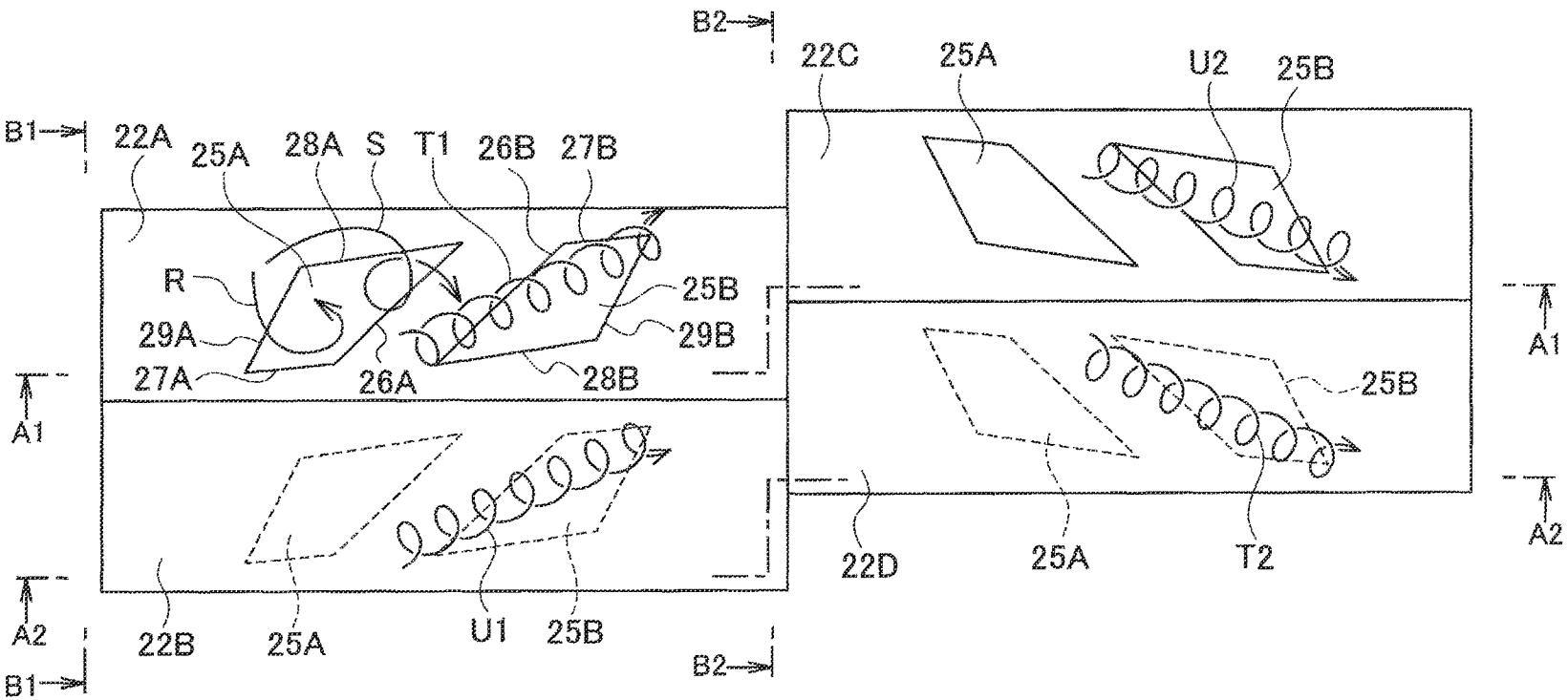
FIG. 7 is a schematic plan view of part of the fin according to the one embodiment of the present invention.

As shown in FIG. 7, the exhaust gas flowing through the exhaust gas passage 20A collides with the forward-tilting protruding piece 25A in each of the segments 22A to 22D, so that its flow is impeded. As a result, the exhaust gas fails to flow straight inside each of the segments 22A to 22D, and a low pressure region is therefore formed immediately downstream of (behind) the forward-tilting protruding piece 25A. In this embodiment, the forward-tilting protruding piece 25A is in a trapezoidal shape (a four- or more-sided polygon) and provides a large region (area) for blocking the flow of the exhaust gas. Thus, the pressure at the low pressure region, which is formed immediately downstream of the forward-tilting protruding piece 25A, is sufficiently low as compared to the case where the protruding piece is in a triangular shape.

Moreover, since the forward-tilting protruding piece 25A is disposed to lean forward toward the upstream side in the exhaust-gas flow direction SD, a flow of exhaust gas that flows forward over the top side 29A of the forward-tilting protruding piece 25A cannot smoothly change its direction upwardly unlike the case where the protruding piece is disposed to lean rearward. In this way, the flow of exhaust gas can be easily drawn into the low pressure region downstream of the forward-tilting protruding piece 25A.

The direction in which the gas flow that flows over the top side 29A of the forward-tilting protruding piece 25A is drawn is a direction toward the peripheral surface where the base side 26A is located. Thus, the gas flow that flows over the top side 29A of the forward-tilting protruding piece 25A forms a strong lateral vortex flow R (see the segment 22A in FIG. 7) at a position downstream of the forward-tilting protruding piece 25A.

Further, gas flows that flow around the left and right sides 27A, 28A of the forward-tilting protruding piece 25A are also drawn into the low pressure region downstream of the forward-tilting protruding piece 25A. The pressure at the low pressure region downstream of the forward-tilting protruding piece 25A is lower at the position of the other of the sides 28A than at the position of the one of the sides 27A. Hence, the gas flow is drawn more easily into the side 28A side. In addition, since the angle a of the one of the sides 27A with respect to the base side 26A is larger than the angle b of the other of the sides 28A with respect to the base side 26A, a larger amount of gas flow S flows around the side 28A side. Hence, the gas flow S, which is stronger than the gas flow on the side 27A side, is drawn into the downstream side of the forward-tilting protruding piece 25A and rotates the lateral vortex flow R mentioned above. The direction in which the gas flow S is drawn is different from the direction in which the gas flow that flows over the top side 29A is drawn. Thus, the gas flow S changes the rotational direction of the lateral vortex flow R.

The strong lateral vortex flow R formed by the gas flow that flows over the top side 29A of the forward-tilting protruding piece 25A is converted into a strong longitudinal vortex flow T1 by the gas flow S that flows around the other of the sides 28A. The longitudinal vortex flow T1 is a vortex that does not decay at an early stage unlike the lateral vortex flow R but lasts long and, as shown in Part (a) of FIG. 9, rotates clockwise in the segment 22A when viewed from the upstream side in the exhaust-gas flow direction SD. As shown in Part (a) of FIG. 8 and Part (a) of FIG. 9, the path of the longitudinal vortex flow T1 is changed by the rearward-tilting protruding piece 25B such that the longitudinal vortex flow T1 is tipped up to an upper side (a region in the segment 22A close to a peripheral surface without the protruding pieces 25 and also close to the one of the sides 27B of the rearward-tilting protruding piece 25B) and flows while disturbing a boundary layer formed in the vicinity of the peripheral surface defining the exhaust gas passage 20A (an exhaust-gas stationary layer around the inner surface of the tube 20, the horizontal wall 23 of the fin 21, etc.). Thus, the longitudinal vortex flow T1 greatly promotes the heat transfer. Accordingly, the heat exchange rate can be improved.

The longitudinal vortex flow T1 tipped up by the rearward-tilting protruding piece 25B in the segment 22A follows the path mentioned above and a large portion of the longitudinal vortex flow T1 enters the segment 22C and a small portion of the longitudinal vortex flow T1 enters the segment 22D as well.

Inside the segment 22C, too, a longitudinal vortex flow U2 is generated by the mechanism mentioned above. The rotational direction of the longitudinal vortex flow U2 is opposite to the longitudinal vortex flow T1 (i.e. counterclockwise rotation in a view as viewed from the upstream side in the exhaust-gas flow direction SD, as shown in Part (b) of FIG. 9) since the protruding pieces 25 in the segment 22C are line-symmetric to the protruding pieces 25 in the segment 22A. The position of the segment 22C in the perpendicular direction CD is shifted (offset) from that of the segment 22A. Thus, as shown in Part (b) of FIG. 9, in the segment 22C, the direction in which the longitudinal vortex flow T1 flows and the direction in which the longitudinal vortex flow U2 flows are the same inside a boundary region between the longitudinal vortex flow T1 and the longitudinal vortex flow U2 (inside the two-dot chain line). This reduces the action that reduces the shear rate between the two longitudinal vortex flows T1, U2 and stops the rotation of the vortex flows. Hence, the lives of the longitudinal vortex flow T1 and the longitudinal vortex flow U2 can be lengthened. By maintaining the vortexes for a longer period of time, the heat exchange rate can be improved to a greater extent. Note that a small portion of a longitudinal vortex flow U1 that is generated inside another segment 22B also enters the segment 22C. The longitudinal vortex flow U1 rotates in the same direction as the longitudinal vortex flow U2 and acts in such a way as to induce the generation of the longitudinal vortex flow U2, which makes it possible to generate a stronger longitudinal vortex flow U2.

Figure 8:
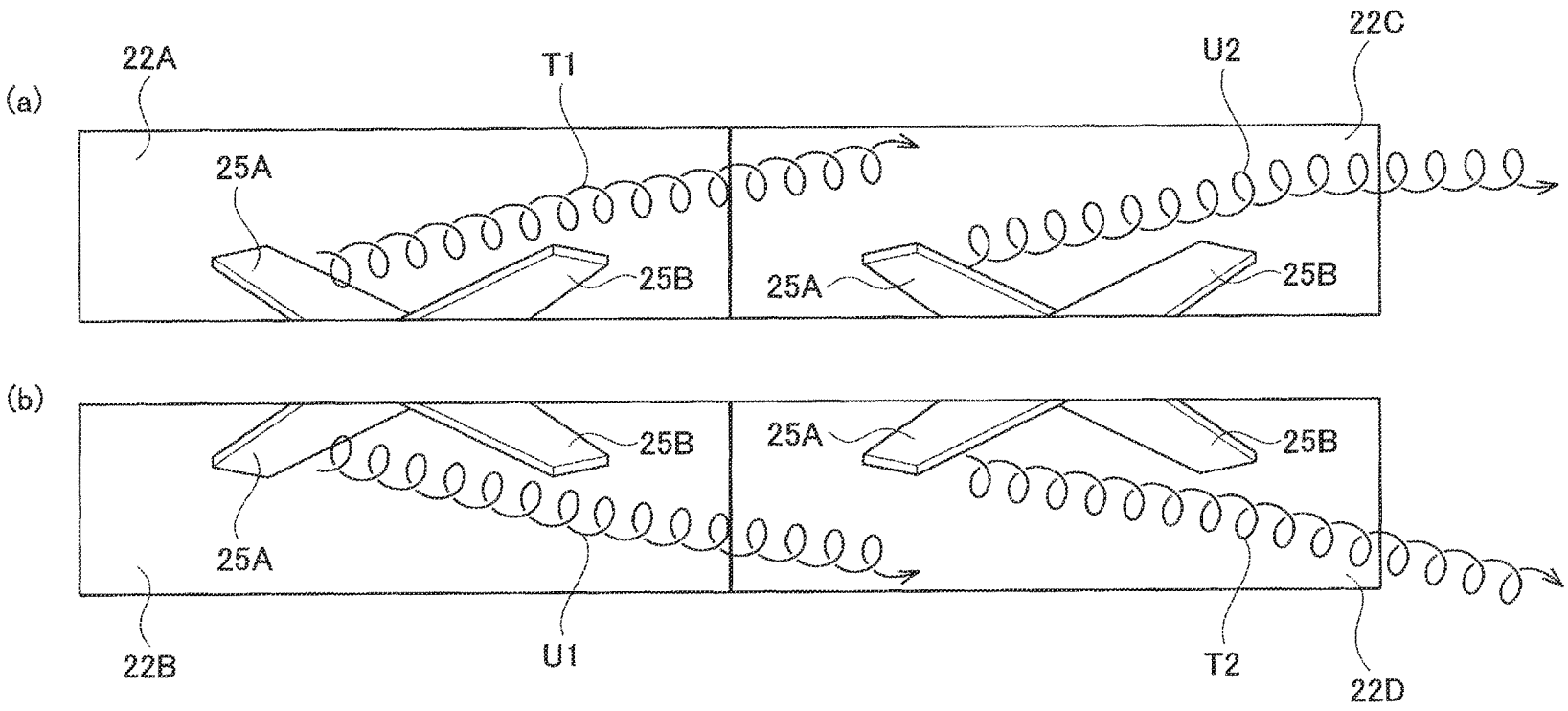
FIG. 8 shows the fin according to the one embodiment of the present invention, and Part (a) is a cross-sectional view taken along line A1-A1 in FIG. 7 and Part (b) is a cross-sectional view taken along line A2-A2 in FIG. 7.
Figure 9:
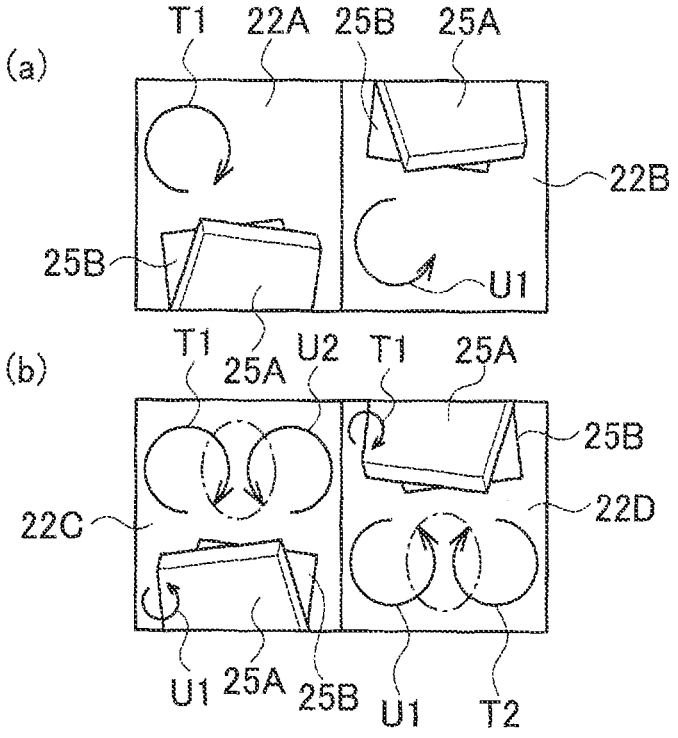
FIG. 9 shows the fin according to the one embodiment of the present invention, and Part (a) is a cross-sectional view taken along line B1-B1 in FIG. 7 and Part (b) is a cross-sectional view taken along line B2-B2 in FIG. 7.

Meanwhile, as shown in FIG. 7, Part (b) of FIG. 8, and Part (a) of FIG. 9, a longitudinal vortex flow U1 that rotates in the direction opposite to the longitudinal vortex flow T1 (counterclockwise direction) is generated in the segment 22B by the mechanism mentioned above. As shown in Part (b) of FIG. 9, a large portion of the longitudinal vortex flow U1 enters the segment 22D. The direction in which the longitudinal vortex flow U1 flows and the direction in which a longitudinal vortex flow T2 generated inside the segment 22D flows (clockwise direction) are the same inside a boundary region between the longitudinal vortex flow T2 and the longitudinal vortex flow U1 (inside the two-dot chain line). Hence, the lives of the longitudinal vortex flow T2 and the longitudinal vortex flow U1 can be lengthened.

Note that some (small portion) of the longitudinal vortex flow T1 generated inside the segment 22A also enters the segment 22D. The longitudinal vortex flow T1 rotates in the same direction as the longitudinal vortex flow T2 and acts in such a way as to induce the generation of the longitudinal vortex flow T2, which makes it possible to generate a stronger longitudinal vortex flow T2.

<Operation and Effects>

In the embodiment described above, the forward-tilting protruding piece 25A is trapezoidal, the base side 26A of the forward-tilting protruding piece 25A is disposed at the orientation angle β1 such that the base side 26A is oriented obliquely with respect to the perpendicular direction CD, and the angle a of the one of the sides 27A with respect to the base side 26A is larger than the angle b of the other of the sides 28A with respect to the base side 26A. In this way, the strong lateral vortex flow R formed by the gas flow that flows over the top side 29A of the forward-tilting protruding piece 25A is converted into the strong longitudinal vortex flow T1 (T2, U1, U2) by the gas flow S that flows around the other of the sides 28A. This longitudinal vortex flow T1 does not decay at an early stage unlike the lateral vortex flow R but lasts long and its path is changed by the rearward-tilting protruding piece 25B such that the longitudinal vortex flow T1 is tipped up to the upper side. The longitudinal vortex flow T1 after its path is changed flows while disturbing the boundary layer formed in the vicinity of a peripheral surface defining the exhaust gas passage 20A (exhaust-gas stationary layer). Thus, the heat transfer is greatly promoted. Accordingly, the heat exchange rate is improved.

Moreover, in this embodiment, the other of the sides 28A is longer than the one of the sides 27A and a stronger lateral vortex flow R can be generated, so that the strength of the conversion from the lateral vortex flow R into the longitudinal vortex flow T1 is increased.

Further, in this embodiment, the top side 29A of the forward-tilting protruding piece 25A is inclined with respect to the base side 26A such that the side 27A side of the top side 29A is lower in the front view as viewed in the exhaust-gas flow direction SD. Also, the other of the sides 28A is located downstream of the one of the sides 27A. In this way, the strength of the convention from the lateral vortex flow R into the longitudinal vortex flow T1 is increased as compared a case where the top side 29A is parallel to the base side 26A when viewed from the exhaust-gas flow direction SD.

Moreover, in this embodiment, the forward-tilting protruding piece 25A and the rearward-tilting protruding piece 25B are provided in each of the segments 22, which are arranged in the exhaust-gas flow direction SD and in the perpendicular direction CD. In this way, the longitudinal vortex flow T1 hits the vertical wall 24 on the side 27B side in addition to the boundary layer (exhaust-gas stationary layer) mentioned above. Thus, the longitudinal vortex flow T1 can greatly promote the heat transfer.

Further, in this embodiment, the forward-tilting protruding pieces 25A in the segments 22 adjacent in the perpendicular direction CD are situated in the same orientation. In this way, the longitudinal vortex flows T1, T2 (rotating clockwise) and longitudinal vortex flows U1, U2 (rotating counterclockwise) mentioned above can be generated, which reduces the action that lowers the shear rate between the vortex flows in each segment 22 and stops the rotation of the vortex flows. Hence, the lives of the vortexes can be lengthened further.

Moreover, in this embodiment, the forward-tilting protruding pieces 25A in the segments 22 adjacent in the exhaust-gas flow direction SD are line-symmetric to each other with respect to the perpendicular direction CD. This, like the above, reduces the action that reduces the shear rate between the vortex flows in each segment 22 and stops the rotation of the vortex flows against each other. Hence, the lives of the vortexes can be lengthened even further.

Further, in this embodiment, the angle a of the one of the sides 27A with respect to the base side 26A is set to be equal to or larger than 90 degrees while the angle b of the other of the sides 28A with respect to the base side 26A is set to be equal to or smaller than 90 degrees. In this way, the distance between the other of the sides 28A and the vertical wall 24 can be maintained substantially constant along the exhaust-gas flow direction SD. Thus, a gas flow S is generated whose strength is substantially constant from the top side 29A to the base side 26A of the forward-tilting protruding piece 25A. With this gas flow S, the lateral vortex flow R can be converted into a stronger longitudinal vortex flow T1.

Moreover, in this embodiment, the rearward-tilting protruding piece 25B is point-symmetric to the forward-tilting protruding piece 25A. In this way, even if the fin 21 is placed back to front when the tube 20 is assembled, the heat exchange rate is not lowered. In addition, there is no possibility of misassembling at the time of manufacturing. Hence, the quality of the heat exchanger 1 is stable.

Further, in this embodiment, the base side 26B of the rearward-tilting protruding piece 25B is located at the same position as the base side 26A of the forward-tilting protruding piece 25A in the front view as viewed in the exhaust-gas flow direction SD. In this way, even if the fin 21 is placed back to front when the tube 20 is assembled, the heat exchange rate is not lowered. In addition, there is no possibility of misassembling at the time of manufacturing. Hence, the quality of the heat exchanger 1 is stable.

<Comparative Evaluation>

Figure 10:
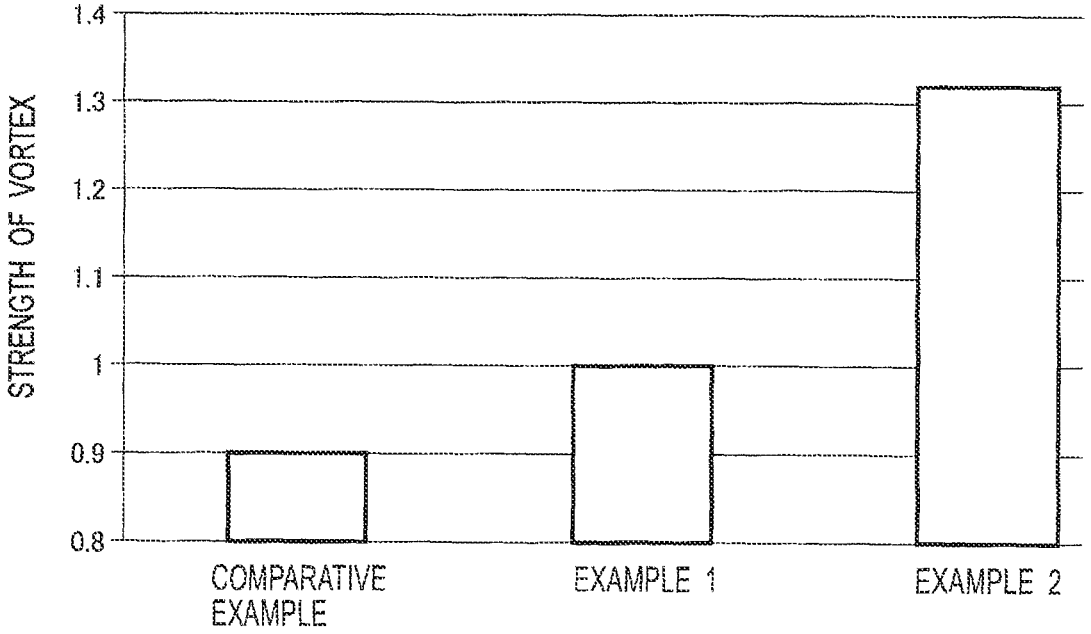
FIG. 10 is a chart showing the strength of vortexes formed by protruding pieces according to Comparative Example and Examples 1 and 2.

Next, the strength of the vortex generated by the protruding pieces 25 (forward-tilting protruding piece 25A and rearward-tilting protruding piece 25B) was evaluated. FIG. 10 shows the strength of vortexes generated by protruding pieces according to Comparative Example and Examples 1 and 2.

Here, the protruding pieces according to Comparative Example are each formed in a trapezoidal shape such that, in a view as viewed from the upstream side in the exhaust-gas flow direction, the top side and the base side are parallel to each other and the angles of the left and right sides with respect to the base side are the same (isosceles trapezoidal shape). The protruding pieces 25 according to Example 1 are each formed in a trapezoidal shape such that, in a view as viewed from the upstream side in the exhaust-gas flow direction SD, the angle of the one of the sides 27A with respect to the base side 26A is 60 degrees while the angle of the other of the sides 28A with respect to the base side 26A is 90 degrees, and the top side 29A is parallel to the base side 26A. The protruding pieces 25 according to Example 2 are those described in the above embodiment.

The strength of the vortexes generated by the protruding pieces according to Comparative Example and Examples 1 and 2 was measured, and the strength of the vortex generated by the protruding pieces according to Example 1, which was set as "1 (reference value)", was compared with the strength of the vortexes generated by the protruding pieces according to Comparative Example and Example 2. As shown in FIG. 10, the vortexes by Examples 1 and 2 were stronger than the vortex by Comparative Example, thereby demonstrating that the vortex generating mechanism mentioned above was capable of generating a stronger vortex flow. Note that the strength of the vortex can be calculated, for example, by calculating a "value $I_A$ of Q per unit area" in a case where the value of Q as the second invariant of a velocity gradient tensor in a given flow-passage cross section is positive and by integrating this $I_A$ for x' (=x/h), where x is the coordinate in the exhaust-gas flow direction SD with the orientation position of the protruding piece (vortex generating portion) set as the origin, and h is the height of the protruding piece.

<Specifications of Protruding Pieces and Segment>

Next, various specifications of the protruding pieces 25 and each segment 22 (parameters that specify the shapes and dimensions of the protruding pieces 25 and the segment 22) will be described. Note that each specification to be described below was evaluated based on the strength of the vortex generated by the protruding pieces 25 according to Example 1 as "1" as a reference.

(Specification 1)

First, Specification 1 of the protruding pieces 25 will be described with reference FIG. 11. Part (a) of FIG. 11 is a perspective view of the protruding pieces 25 and Part (b) of FIG. 11 is a characteristic chart showing changes in the strength of the vortex as a result of changing the forward tilt angle α1 of the forward-tilting protruding piece 25A.

Here, the forward tilt angle α1 of the forward-tilting protruding piece 25A was changed with the orientation angle β1 set at 45 degrees, the angle a of the one of the sides 27A with respect to the base side 26A set at 135 degrees, and the angle b of the other of the sides 28A with respect to the base side 26A set at 45 degrees.

Figure 11:
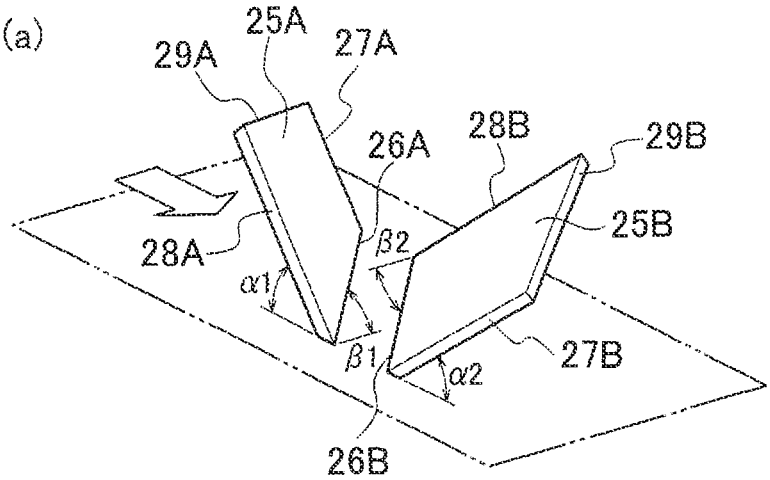
FIG. 11 is a view and a chart describing Specification 1 of the present invention, and Part (a) is a perspective view of the protruding pieces and Part (b) is a characteristic chart showing changes in the strength of the vortex as a result of changing the forward tilt angle of the forward-tilting protruding piece.
Figure 11:
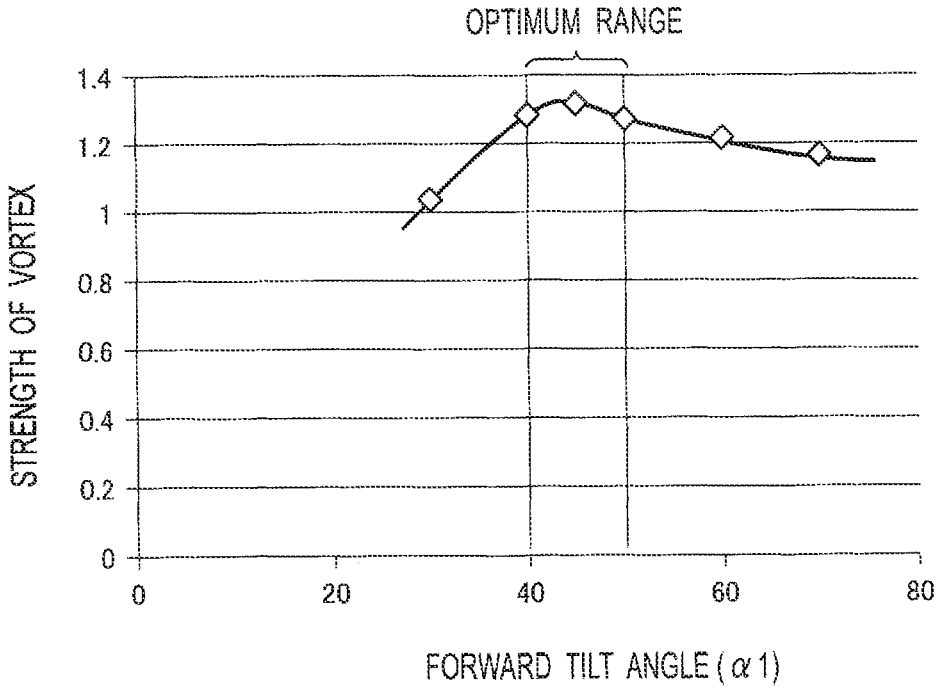

As shown in Parts (a) and (b) of FIG. 11, a stronger vortex than that in Example 1 can be obtained by setting the forward tilt angle α1 of the forward-tilting protruding piece 25A at 30 to 90 degrees with respect to the exhaust-gas flow direction SD.

In particular, the forward tilt angle α1 of the forward-tilting protruding piece 25A is preferably 40 to 50 degrees with respect to the exhaust-gas flow direction SD. In this way, the strength of the vortex is "1.25" or higher as compared to that in Example 1 (the strength of the vortex="1.00").

(Specification 2)

Next, Specification 2 of the protruding pieces 25 will be described with reference to FIG. 12. Part (a) of FIG. 12 is a perspective view of the protruding pieces 25 and Part (b) of FIG. 12 is a characteristic chart showing changes in the strength of the vortex as a result of changing the orientation angle β1 of the forward-tilting protruding piece 25A.

Here, the orientation angle β1 of the forward-tilting protruding piece 25A was changed with the forward tilt angle α1 set at 45 degrees, the angle a of the one of the sides 27A with respect to the base side 26A set at 135 degrees, and the angle b of the other of the sides 28A with respect to the base side 26A set at 45 degrees.

Figure 12:
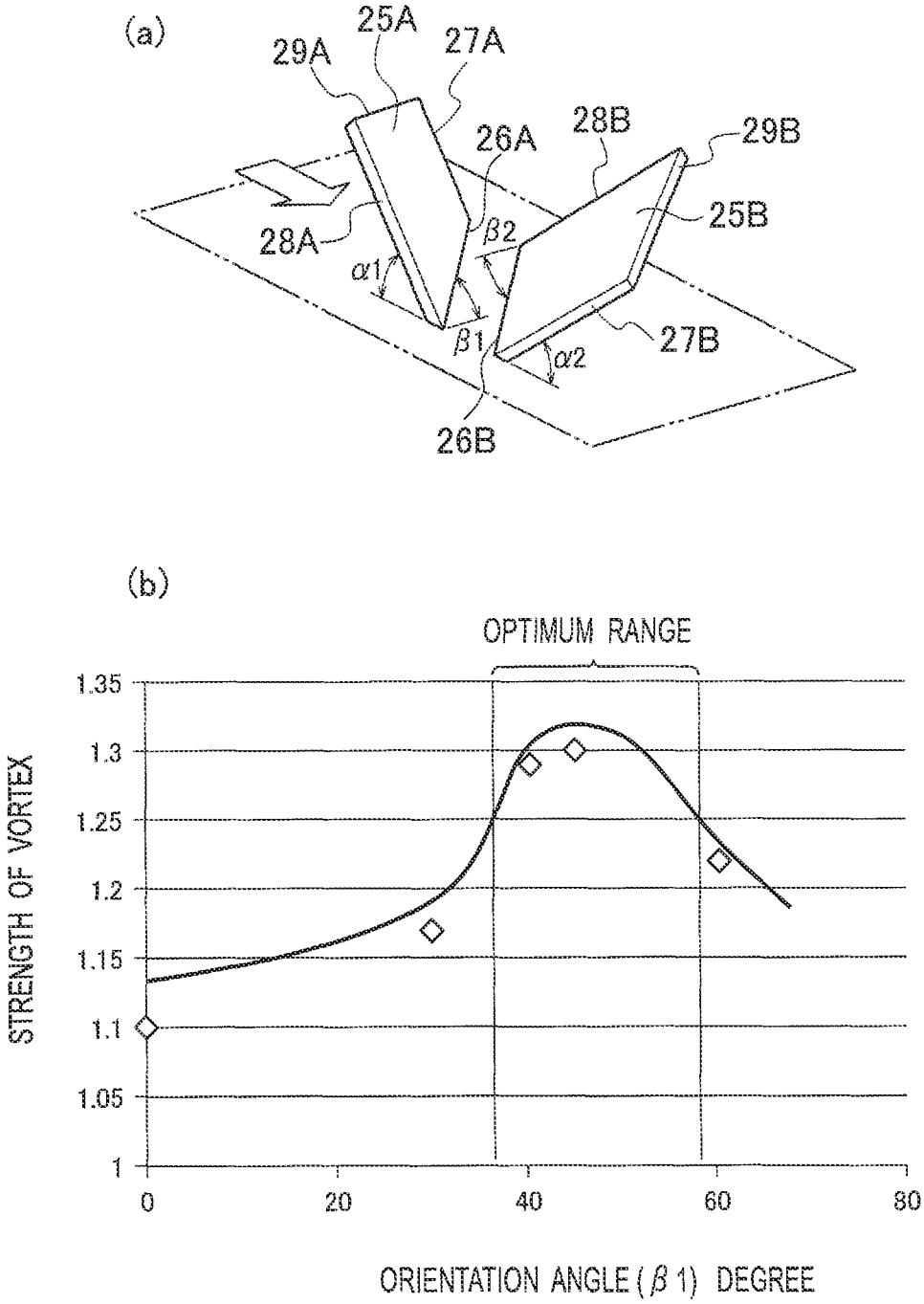
FIG. 12 is a view and a chart describing Specification 2 of the present invention, and Part (a) is a perspective view of the protruding pieces and Part (b) is a characteristic chart showing changes in the strength of the vortex as a result of changing the orientation angle of the forward-tilting protruding piece.

As shown in Parts (a) and (b) of FIG. 12, a stronger vortex (the strength of the vortex="1.1" or higher) than that in Example 1 can be obtained by setting the orientation angle β1 of the forward-tilting protruding piece 25A at 10 to 60 degrees with respect to the perpendicular direction CD.

In particular, the orientation angle β1 of the forward-tilting protruding piece 25A is preferably 35 to 60 degrees with respect to the perpendicular direction CD. In this way, the strength of the vortex is "1.25" or higher as compared to that in Example 1 (the strength of the vortex="1.00").

(Specification 3)

Next, Specification 3 of the protruding pieces 25 will be described with reference to FIG. 13. Part (a) of FIG. 13 is a perspective view of the protruding pieces 25, Part (b) of FIG. 13 is a front view of the forward-tilting protruding piece 25A, and Part (c) of FIG. 13 is a characteristic chart showing changes in the strength of the vortex as a result of changing a radius of curvature R1 of a corner formed between the side 27A and the top side 29A of the forward-tilting protruding piece 25A and a radius of curvature R2 of a corner formed between the side 28A and the top side 29A of the forward-tilting protruding piece 25A.

Here, the radius of curvature R1 of the corner formed between the side 27A and the top side 29A of the forward-tilting protruding piece 25A and the radius of curvature R2 of the corner formed between the side 28A and the top side 29A of the forward-tilting protruding piece 25A were changed with the forward tilt angle α1 set at 45 degrees, the orientation angle β1 set at 45 degrees, the angle a of the one of the sides 27A with respect to the base side 26A set at 135 degrees, and the angle b of the other of the sides 28A with respect to the base side 26A set at 45 degrees.

Figure 13:
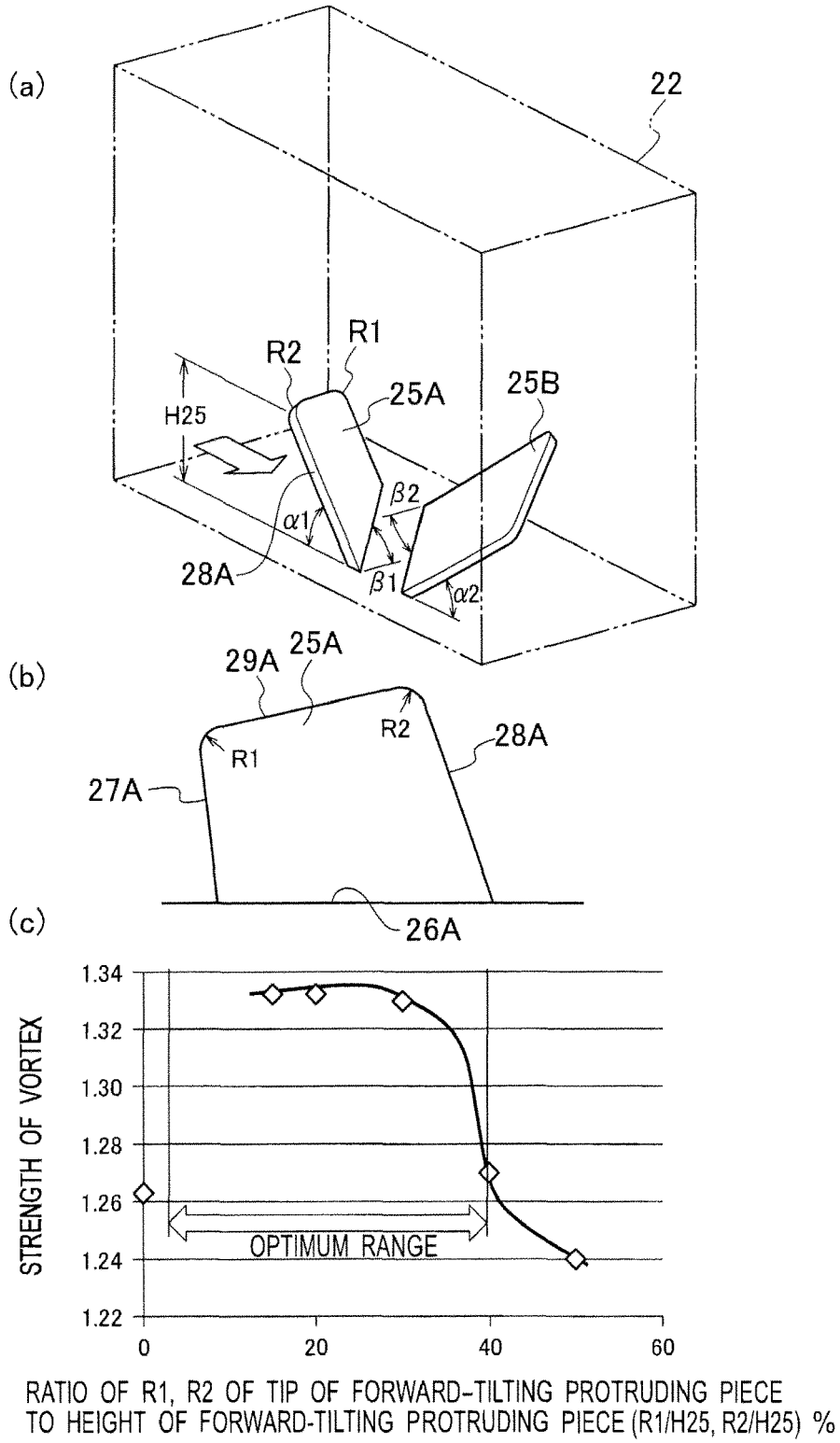
FIG. 13 is views and a chart describing Specification 3 of the present invention, and Part (a) is a perspective view of the protruding pieces, Part (b) is a front view of the forward-tilting protruding piece, and Part (c) is a characteristic chart showing changes in the strength of the vortex as a result of changing a round shape at a corner formed between each side and a top side of the forward-tilting protruding piece.

As shown in Parts (a) and (b) of FIG. 13, the corner between the one of the sides 27A and the top side 29A of the forward-tilting protruding piece 25A is given a circular shape (round shape) for the purpose of lengthening the life of a cutting tool. The radius of curvature R1 of the corner formed between the side 27A and the top side 29A of the forward-tilting protruding piece 25A and the radius of curvature R2 of the corner formed between the side 28A and the top side 29A of the forward-tilting protruding piece 25A are preferably 5 to 55% of a height H25 of the forward-tilting protruding piece 25A from the base side 26A to the highest point on the top side 29A. In this way, the strength of the vortex is "1.25" or higher as compared to that in Example 1 (the strength of the vortex="1.00").

(Specification 4)

Next, Specification 4 of the protruding pieces 25 will be described with reference to FIG. 14. Part (a) of FIG. 14 is a perspective view of the protruding pieces 25 and Part (b) of FIG. 14 is a characteristic chart showing changes in the strength of the vortex as a result of changing a width W25 of the forward-tilting protruding piece 25A.

Here, the ratio of the width W25 of the forward-tilting protruding piece 25A in the perpendicular direction CD to a width W22 of the exhaust gas passage 20A (segment 22) was changed. Note that the other conditions of the forward-tilting protruding piece 25A are similar to those in Specification 3.

Figure 14:
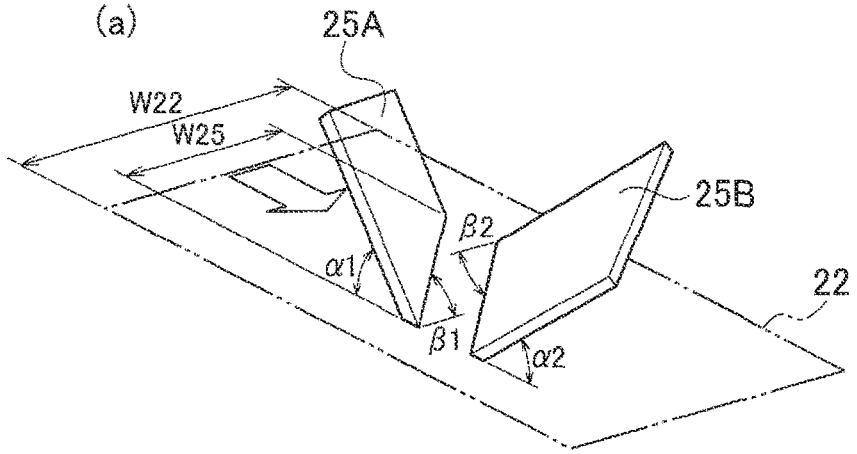
FIG. 14 is a view and a chart describing Specification 4 of the present invention, and Part (a) is a perspective view of the protruding pieces and Part (b) is a characteristic chart showing changes in the strength of the vortex as a result of changing the width of the forward-tilting protruding piece.
Figure 14:
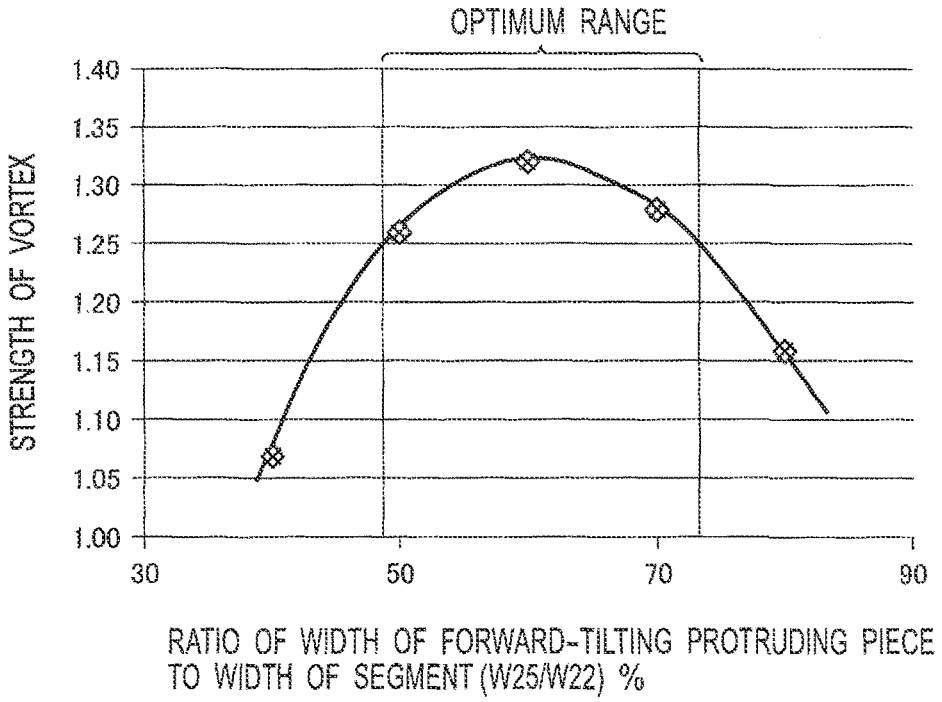

As shown in Parts (a) and (b) of FIG. 14, a stronger vortex (the strength of the vortex="1.1" or higher) than that in Example 1 can be obtained by setting the ratio of the width W25 of the forward-tilting protruding piece 25A to the width W22 of the exhaust gas passage 20A (segment 22) at 40 to 80%.

In particular, the ratio of the width W25 of the forward-tilting protruding piece 25A to the width W22 of the segment 22 is preferably 50 to 75%. In this way, the strength of the vortex is "1.25" or higher as compared to that in Example 1 (the strength of the vortex="1.00").

(Specification 5)

Next, Specification 5 of the protruding pieces 25 will be described with reference to FIG. 15. Part (a) of FIG. 15 is a perspective view of the protruding pieces 25 and Part (b) of FIG. 15 is a characteristic chart showing changes in the strength of the vortex as a result of changing the height H25 of the forward-tilting protruding piece 25A.

Here, the ratio of the height H25 of the forward-tilting protruding piece 25A to a height H22 of the exhaust gas passage 20A (segment 22) was changed. Note that the other conditions of the forward-tilting protruding piece 25A are similar to those in Specification 3.

Figure 15:
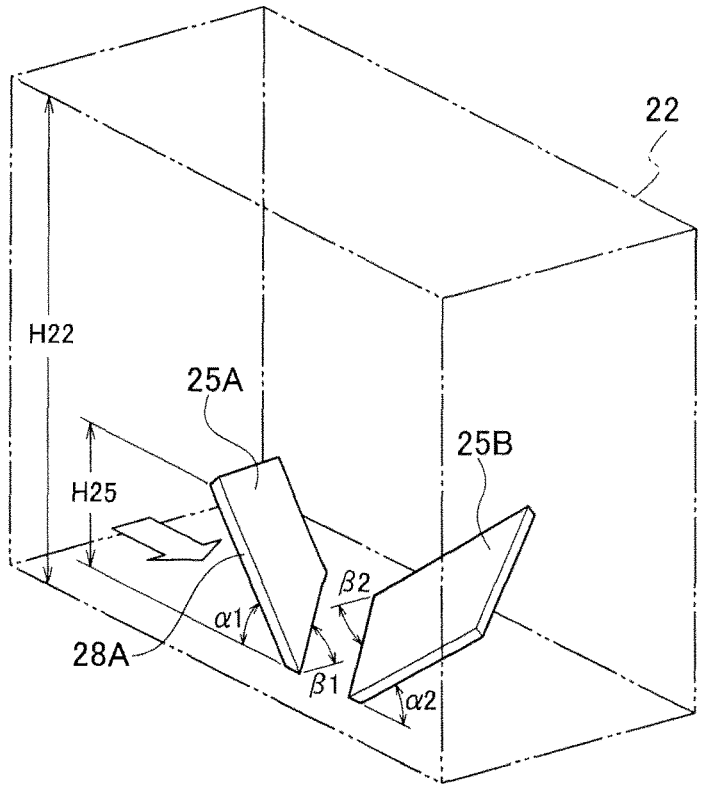
FIG. 15 is a view and a chart describing Specification 5 of the present invention, and Part (a) is a perspective view of the protruding pieces and Part (b) is a characteristic chart showing changes in the strength of the vortex as a result of changing the height of the forward-tilting protruding piece.
Figure 15:
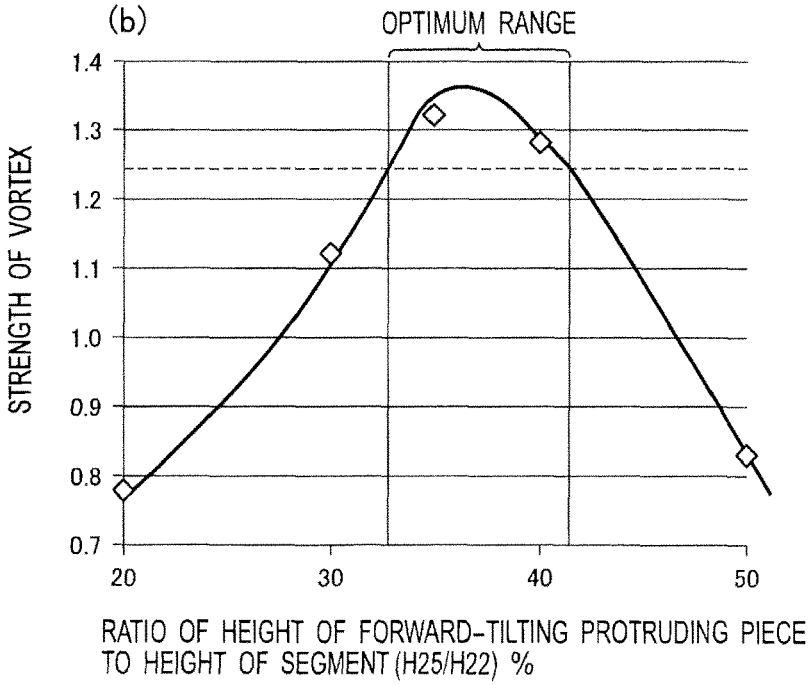

As shown in Parts (a) and (b) of FIG. 15, a stronger vortex than that in Example 1 can be obtained by setting the ratio of the height H25 of the forward-tilting protruding piece 25A to the height H22 of the exhaust gas passage 20A (segment 22) at 25 to 45%.

In particular, the ratio of the height H25 of the forward-tilting protruding piece 25A to the height H22 of the exhaust gas passage 20A (segment 22) is preferably 33 to 42%. In this way, the strength of the vortex is "1.25" or higher as compared to that in Example 1 (the strength of the vortex="1.00").

(Specification 6)

Next, Specification 6 of the protruding pieces 25 will be described with reference to FIG. 16. Part (a) of FIG. 16 is a perspective view of the protruding pieces 25 and Part (b) of FIG. 16 is a characteristic chart showing changes in the strength of the vortex as a result of changing a length L28 of the other of the sides 28A of the forward-tilting protruding piece 25A.

Here, the ratio of the length L28 of the other of the sides 28A of the forward-tilting protruding piece 25A in the exhaust-gas flow direction SD to a length L22 of the segment 22 in the exhaust-gas flow direction SD was changed. Note that the other conditions of the forward-tilting protruding piece 25A are similar to those in Specification 3.

Figure 16:
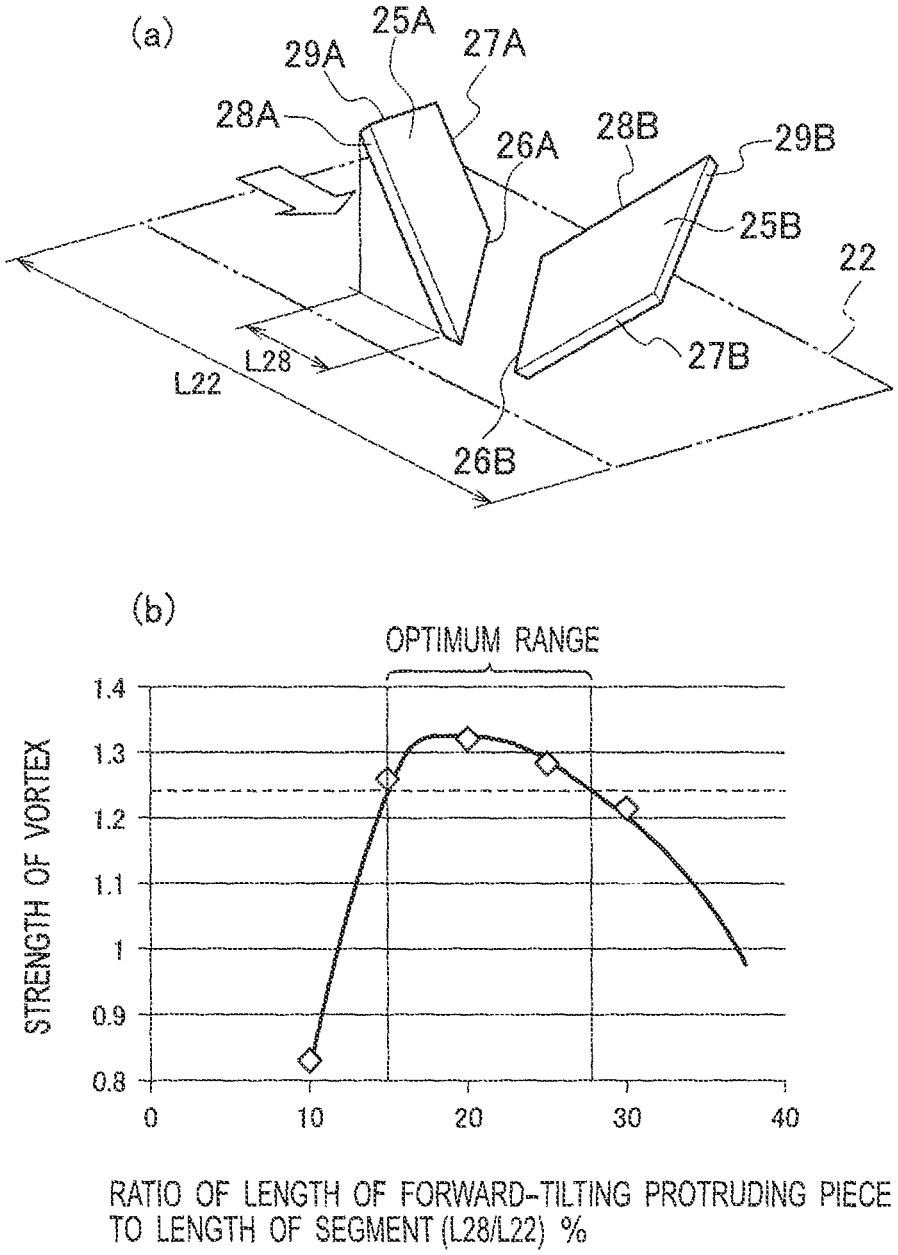
FIG. 16 is a view and a chart describing Specification 6 of the present invention, and Part (a) is a perspective view of the protruding pieces and Part (b) is a characteristic chart showing changes in the strength of the vortex as a result of changing the length of the other of the sides of the forward-tilting protruding piece.

As shown in Parts (a) and (b) of FIG. 16, a stronger vortex than that in Example 1 can be obtained by setting the length L28 of the forward-tilting protruding piece 25A to be 12 to 35% of the length L22 of the segment 22 in the exhaust-gas flow direction SD.

In particular, the length L28 of the forward-tilting protruding piece 25A is preferably 15 to 28% of the length L22 of the segment 22. In this way, the strength of the vortex is "1.25" or higher as compared to that in Example 1 (the strength of the vortex="1.00").

(Specification 7)

Next, Specification 7 of the protruding pieces 25 will be described with reference to FIG. 17. Part (a) of FIG. 17 is a perspective view of the protruding pieces 25 and Part (b) of FIG. 17 is a characteristic chart showing changes in the strength of the vortex as a result of changing a minimum distance D between the forward-tilting protruding piece 25A and the rearward-tilting protruding piece 25B.

Here, the minimum distance D between the forward-tilting protruding piece 25A and the rearward-tilting protruding piece 25B was changed. Note that the other conditions of the forward-tilting protruding piece 25A are similar to those in Specification 3.

Figure 17:
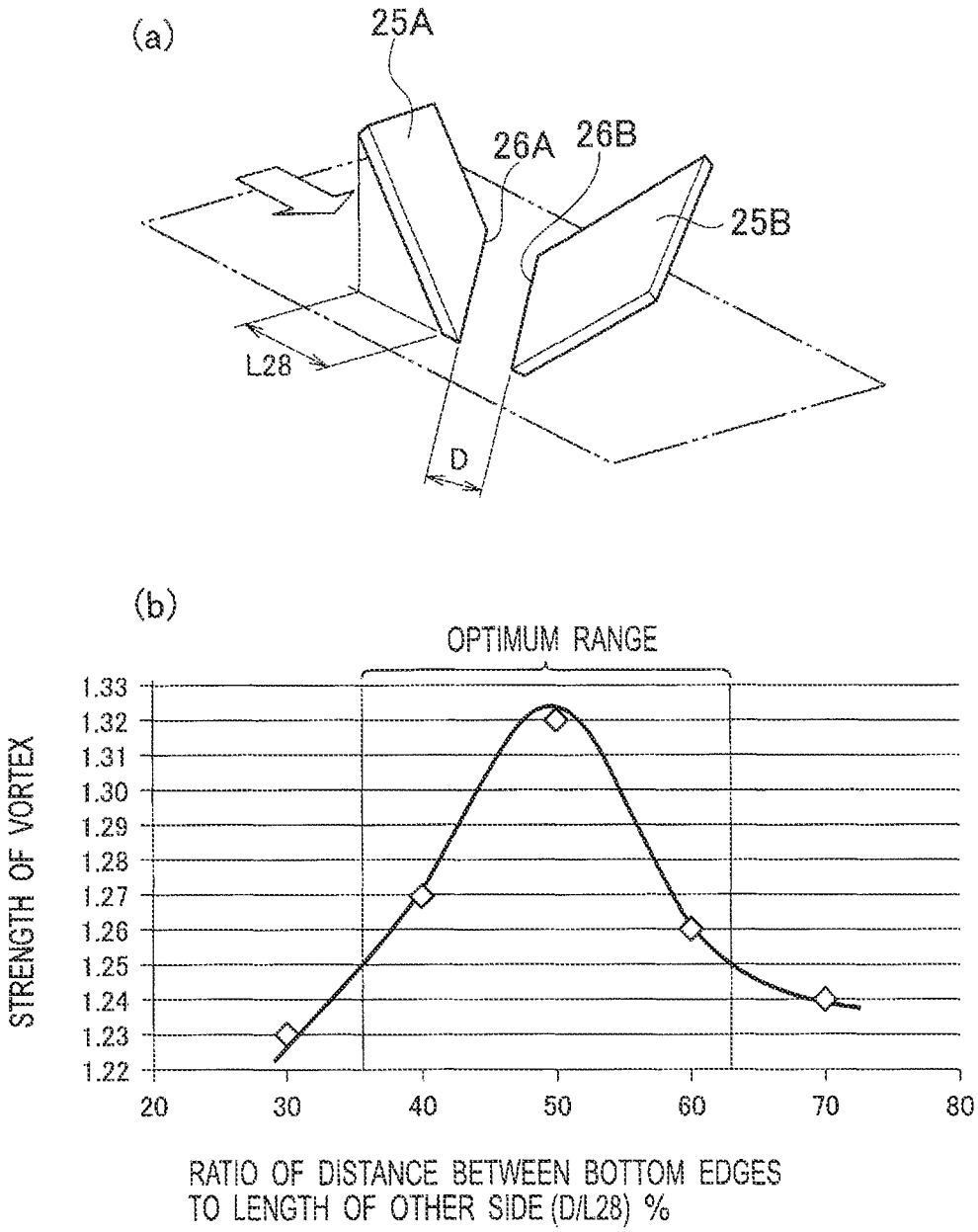
FIG. 17 is a view and a chart describing Specification 7 of the present invention, and Part (a) is a perspective view of the protruding pieces and Part (b) is a characteristic chart showing changes in the strength of the vortex as a result of changing the minimum distance between the forward-tilting protruding piece and the rearward-tilting protruding piece.

As shown in Parts (a) and (b) of FIG. 17, a stronger vortex (the strength of the vortex="1.23" or higher) than that in Example 1 can be obtained by setting the minimum distance D between the forward-tilting protruding piece 25A and the rearward-tilting protruding piece 25B to be 30 to 70% of the length L28 of the other of the sides 28A of the forward-tilting protruding piece 25A in the exhaust-gas flow direction SD.

In particular, the minimum distance D between the forward-tilting protruding piece 25A and the rearward-tilting protruding piece 25B is preferably 36 to 65% of the length L28 of the other of the sides 28A of the forward-tilting protruding piece 25A. In this way, the strength of the vortex is "1.25" or higher as compared to that in Example 1 (the strength of the vortex="1.00").

(Specification 8)

Next, Specification 8 of the protruding pieces 25 will be described with reference to FIG. 18. Part (a) of FIG. 18 is a perspective view of the protruding pieces 25 and Part (b) of FIG. 18 is a characteristic chart showing changes in the strength of the vortex as a result of changing the location of the center c of the base side 26A of the forward-tilting protruding piece 25A.

Here, the location of the center c of the base side 26A of the forward-tilting protruding piece 25A was changed. Note that the other conditions of the forward-tilting protruding piece 25A are similar to those in Specification 3.

Figure 18:
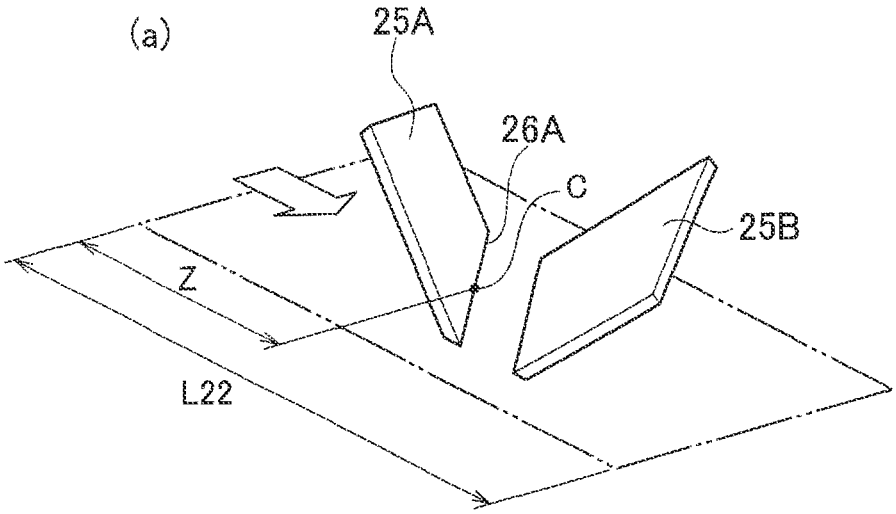
FIG. 18 is a view and a chart describing Specification 8 of the present invention, and Part (a) is a perspective view of the protruding pieces and Part (b) is a characteristic chart showing changes in the strength of the vortex as a result of changing the location of the center of a base side of the forward-tilting protruding piece (the position of the mid-point of the base side).
Figure 18:
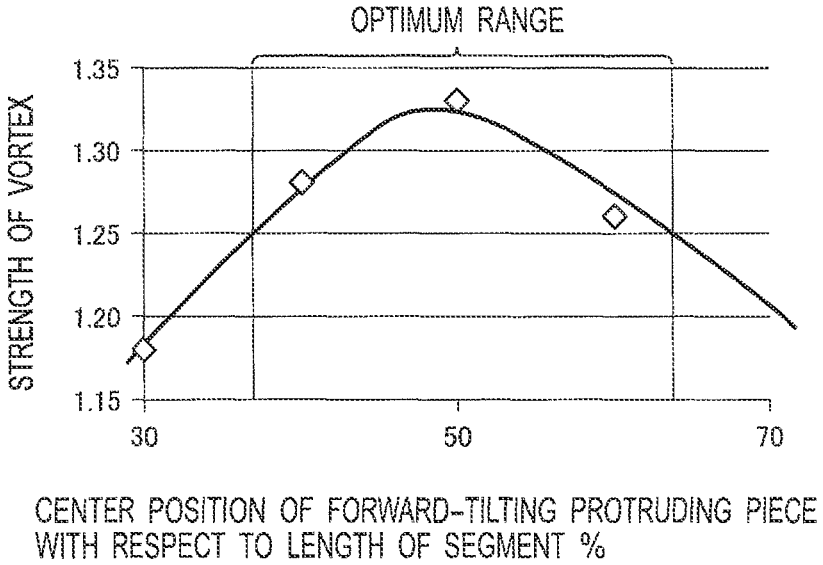

As shown in Parts (a) and (b) of FIG. 18, a stronger vortex (the strength of the vortex="1.17" or higher) than that in Example 1 can be obtained by setting the location of the center c of the base side 26A of the forward-tilting protruding piece 25A within a range z covering 30 to 70% of the length L22 of the segment 22 in the exhaust-gas flow direction SD from the upstream side of the segment 22.

In particular, the location of the center c of the base side 26A of the forward-tilting protruding piece 25A is preferably provided within a range z covering 35 to 65% of the length L22 of the segment 22 in the exhaust-gas flow direction SD from the upstream side of the segment 22. In this way, the strength of the vortex is "1.25" or higher as compared to that in Example 1 (the strength of the vortex="1.00").

(Specification 9)

Next, Specification 9 of the protruding pieces 25 will be described with reference to FIG. 19. Part (a) of FIG. 19 is a perspective view of the protruding pieces 25 and Part (b) of FIG. 19 is a characteristic chart showing changes in the strength of the vortex as a result of changing the location of the center c of the base side 26A of the forward-tilting protruding piece 25A.

Here, the location of the center c of the base side 26A of the forward-tilting protruding piece 25A was changed. Note that the other conditions are similar to those in Specification 3 of the forward-tilting protruding piece 25A.

Figure 19:
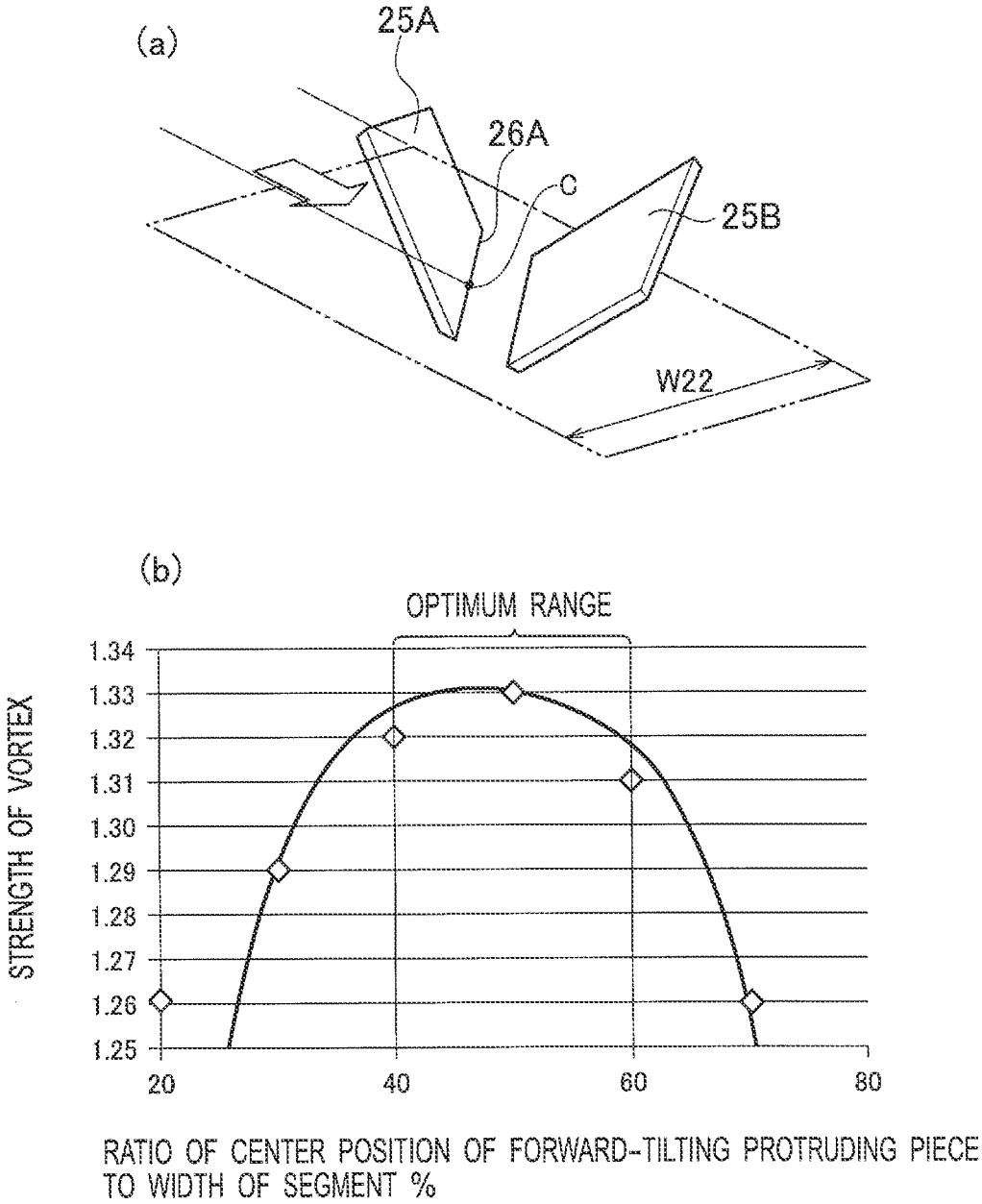
FIG. 19 is a view and a chart describing Specification 9 of the present invention, and Part (a) is a perspective view of the protruding pieces and Part (b) is a characteristic chart showing changes in the strength of the vortex as a result of changing the location of the center of the base side of the forward-tilting protruding piece.

As shown in Parts (a) and (b) of FIG. 19, the location of the center c of the base side 26A of the forward-tilting protruding piece 25A is preferably within a range covering 25 to 70% of the width W22 of the segment 22 in the perpendicular direction CD with the center thereof in the widthwise direction as a reference (50%). In this way, a stronger vortex (the strength of the vortex="1.25" or higher) than that in Example 1 (the strength of the vortex="1.00") can be obtained.

In particular, the location of the center c of the base side 26A of the forward-tilting protruding piece 25A is preferably within a range covering 40 to 60% of the width W22 of the segment 22 with the center thereof in the widthwise direction as a reference. In this way, the strength of the vortex is "1.31" or higher as compared to that in Example 1 (the strength of the vortex="1.00").

(Specification 10)

Next, Specification 10 of the protruding pieces 25 will be described with reference to FIG. 20. Part (a) of FIG. 20 is a front view of the protruding pieces 25 and Part (b) of FIG. 20 is a characteristic chart showing changes in the strength of the vortex as a result of changing the ratio of overlap between the forward-tilting protruding piece 25A and the rearward-tilting protruding piece 25B.

Here, the ratio of overlap between the forward-tilting protruding piece 25A and the rearward-tilting protruding piece 25B was changed, specifically, the proportion of an overlapping area between a projected area of the forward-tilting protruding piece 25A and a projected area of the rearward-tilting protruding piece 25B in their projections in the exhaust-gas flow direction SD to the area of projection of the forward-tilting protruding piece 25A was changed. Note that the other conditions of the forward-tilting protruding piece 25A are similar to those in Specification 3.

Figure 20:
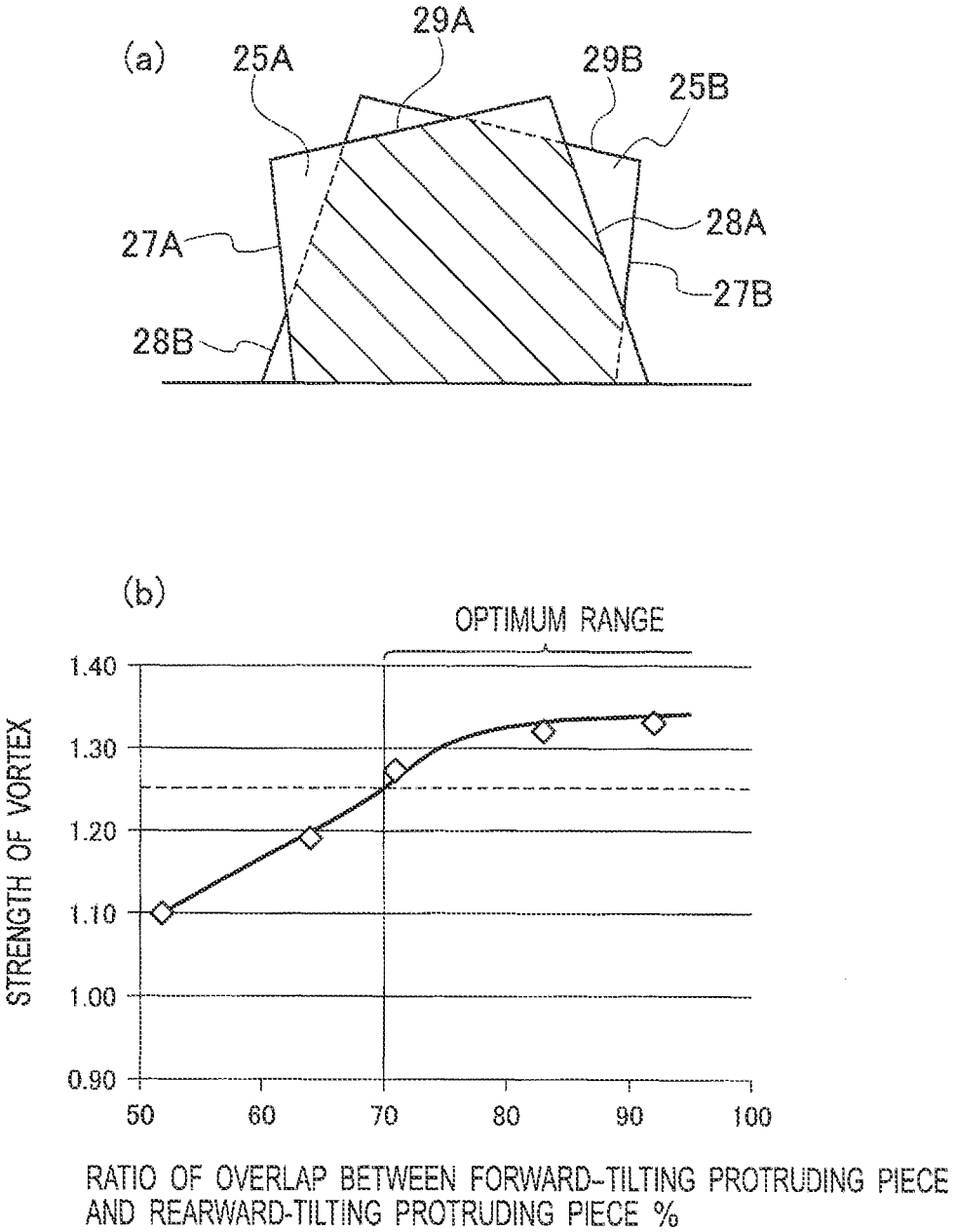
FIG. 20 is a view and a chart describing Specification 10 of the present invention, and Part (a) is a front view of the protruding pieces and Part (b) is a characteristic chart showing changes in the strength of the vortex as a result of changing the ratio of overlap between the forward-tilting protruding piece and the rearward-tilting protruding piece.

As shown in Parts (a) and (b) of FIG. 20, a stronger vortex (the strength of the vortex="1.10" or higher) than that in Example 1 (the strength of the vortex="1.00") can be obtained by setting the ratio of overlap between the forward-tilting protruding piece 25A and the rearward-tilting protruding piece 25B at 50% or higher.

In particular, the forward-tilting protruding piece 25A is preferably such that the ratio of overlap between the forward-tilting protruding piece 25A and the rearward-tilting protruding piece 25B is 70% or higher. In this way, the strength of the vortex is "1.25" or higher as compared to that in Example 1 (the strength of the vortex="1.00").

(Specification 11)

Next, Specification 11 of the segment 22 will be described with reference to FIG. 21. Part (a) of FIG. 21 is a perspective view of the protruding pieces 25 and the segment 22 and Part (b) of FIG. 21 is a characteristic chart showing changes in the strength of the vortex as a result of changing dimensions of the segment 22.

Here, the height H22 of the segment 22 in the tube stacking direction PD and the length L22 of the segment 22 in the exhaust-gas flow direction SD were changed. Note that besides the structure of the segment 22, the conditions of the protruding pieces 25 are similar to those in Specification 3.

Figure 21:
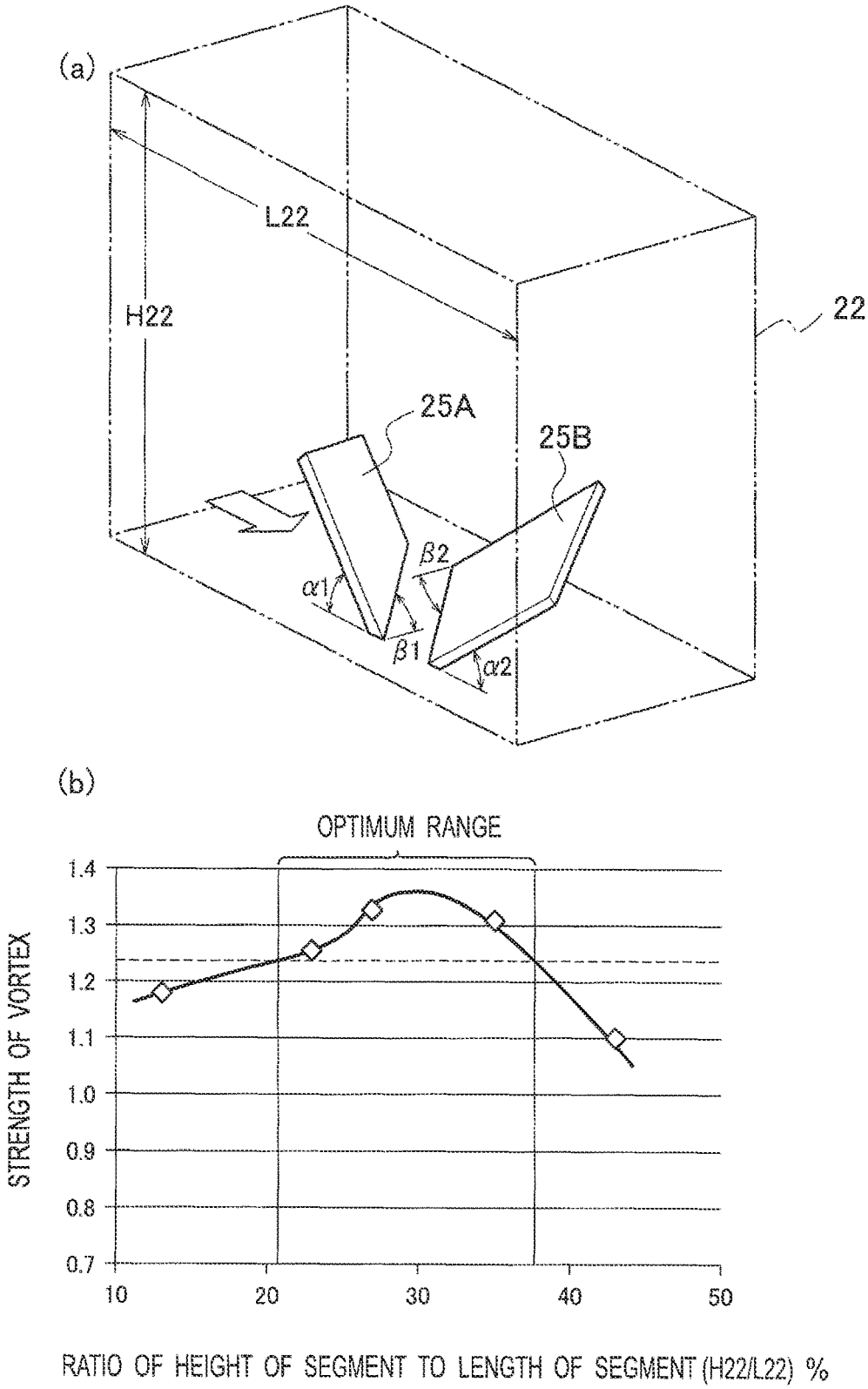
FIG. 21 is a view and a chart describing Specification 11 of the present invention, and Part (a) is a perspective view showing the relationship between the protruding pieces and the segment and Part (b) is a characteristic chart showing changes in the strength of the vortex as a result of changing dimensions of the segment.

As shown in Parts (a) and (b) of FIG. 21, the height H22 of the segment 22 is preferably set to be 22 to 38% of the length L22 of the segment 22. In this way, the strength of the vortex is "1.25" or higher as compared to that in Example 1 (the strength of the vortex="1.00").

(Specification 12)

Next, Specification 12 of the segment 22 will be described with reference to FIG. 22. Part (a) of FIG. 22 is a perspective view showing the protruding pieces 25 and part of the segment 22 and Part (b) of FIG. 22 is a characteristic chart showing changes in the strength of the vortex as a result of changing the segment 22.

Here, the width W22 of the segment 22 in the perpendicular direction CD and the length L22 of the segment 22 in the exhaust-gas flow direction SD were changed. Note that besides the structure of the segment 22, the conditions of the protruding pieces 25 are similar to those in Specification 3.

Figure 22:
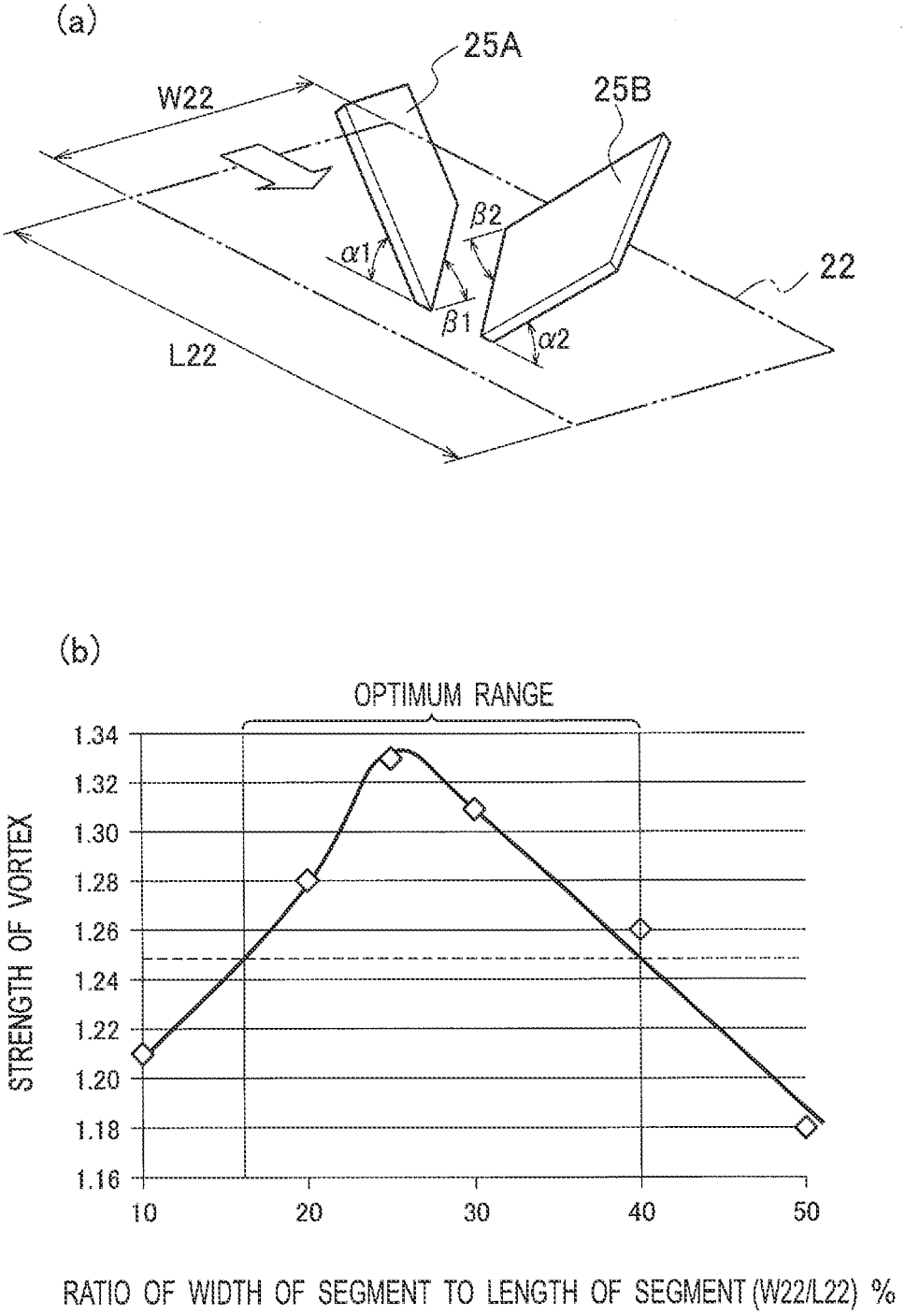
FIG. 22 is a view and a chart describing Specification 12 of the present invention, and Part (a) is a perspective view showing the relationship between the protruding pieces and the segment and Part (b) is a characteristic chart showing changes in the strength of the vortex as a result of changing dimensions of the segment.

As shown in Parts (a) and (b) of FIG. 22, the width W22 of the segment 22 is preferably set to be 15 to 40% of the length L22 of the segment 22. In this way, the strength of the vortex is "1.25" or higher as compared to that in Example 1 (the strength of the vortex="1.00").

(Specification 13)

Next, Specification 13 of the segment 22 will be described with reference to FIG. 23. Part (a) of FIG. 23 is a perspective view of the protruding pieces 25 and the segment 22 and Part (b) of FIG. 23 is a characteristic chart showing changes in the strength of the vortex as a result of changing the segment 22.

Here, the width W22 and the height H22 of the segment 22 were changed. Note that besides the structure of the segment 22, the conditions of the protruding pieces 25 are similar to those in Specification 3.

Figure 23:
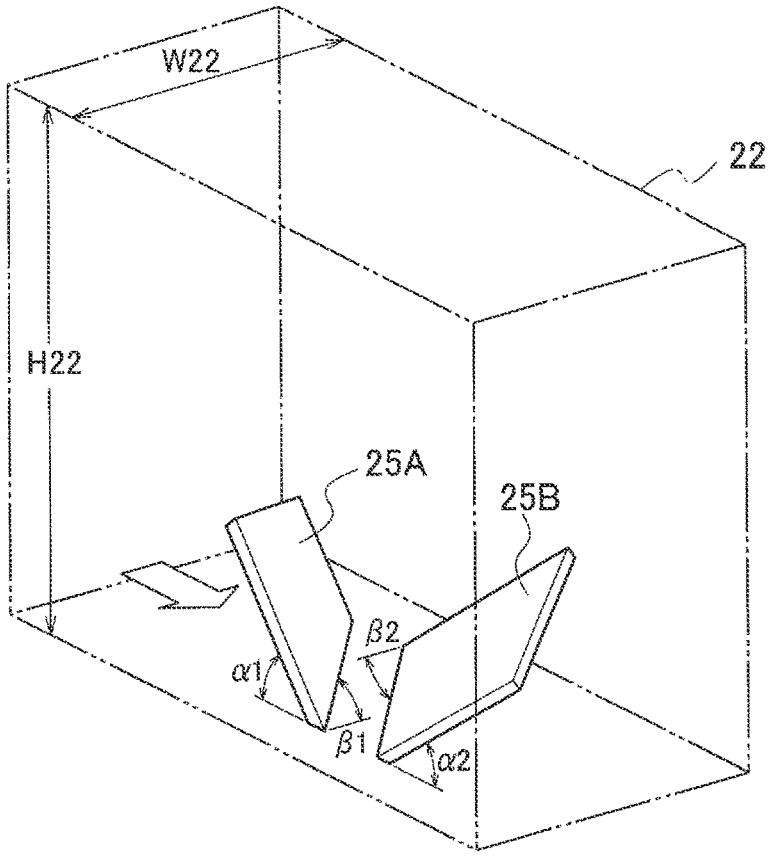
FIG. 23 is a view and a chart describing Specification 13 of the present invention, and Part (a) is a perspective view showing the relationship between the protruding pieces and the segment and Part (b) is a characteristic chart showing changes in the strength of the vortex as a result of changing dimensions of the segment.
Figure 23:
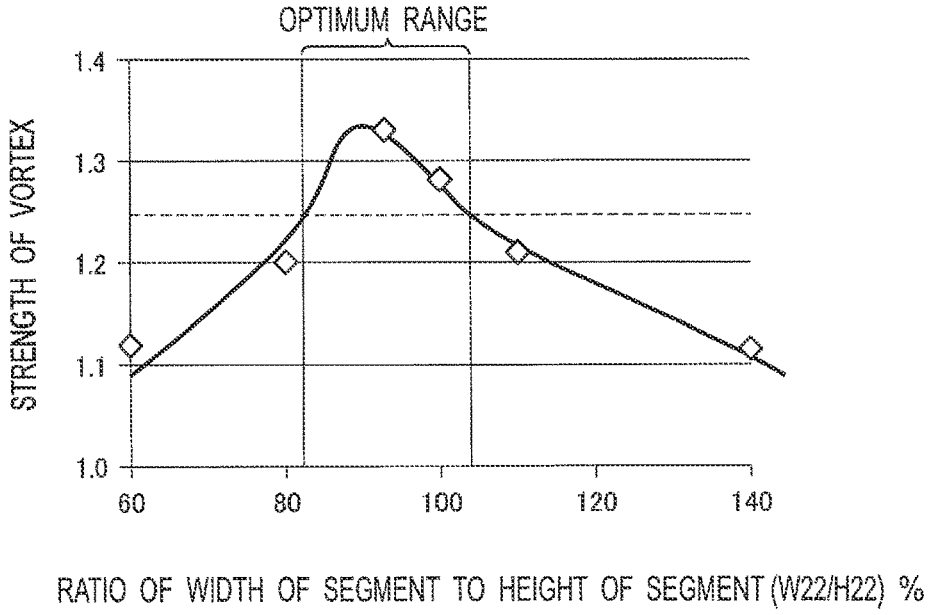

As shown in Parts (a) and (b) of FIG. 23, the width W22 of the segment 22 is preferably set to be 82 to 112% of the height H22 of the segment 22. In this way, the strength of the vortex is "1.25" or higher as compared to that in Example 1 (the strength of the vortex="1.00").

(Specification 14)

Next, Specification 14 of the segment 22 will be described with reference to FIG. 24. Part (a) of FIG. 24 is a perspective view of the protruding pieces 25 and the segment 22 and Part (b) of FIG. 24 is a characteristic chart showing changes in the strength of the vortex as a result of changing the amount of shift between the segments 22 adjacent in the exhaust-gas flow direction SD (the amount of shift between their positions in the perpendicular direction CD).

Here, the amount of shift between the segments 22 adjacent in the exhaust-gas flow direction SD was changed. Note that besides the structure of each segment 22, the conditions of the protruding pieces 25 are similar to those in Specification 3.

Figure 24:
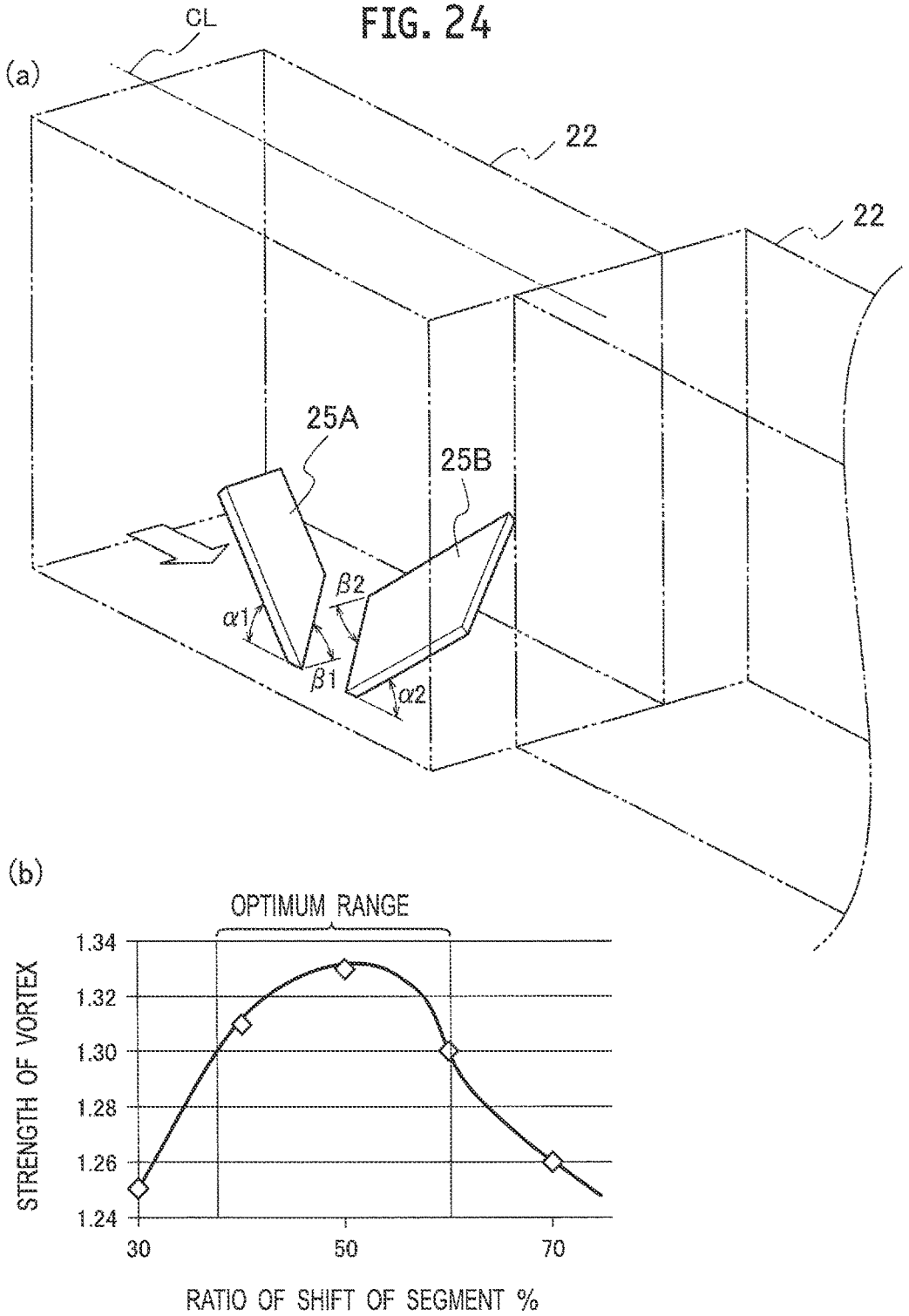
FIG. 24 is a view and a chart describing Specification 14 of the present invention, and Part (a) is a perspective view showing the relationship between the protruding pieces and the segment and Part (b) is a characteristic chart showing changes in the strength of the vortex as a result of changing the amount of shift between the segments adjacent in an exhaust-gas flow direction.
Figure 25:
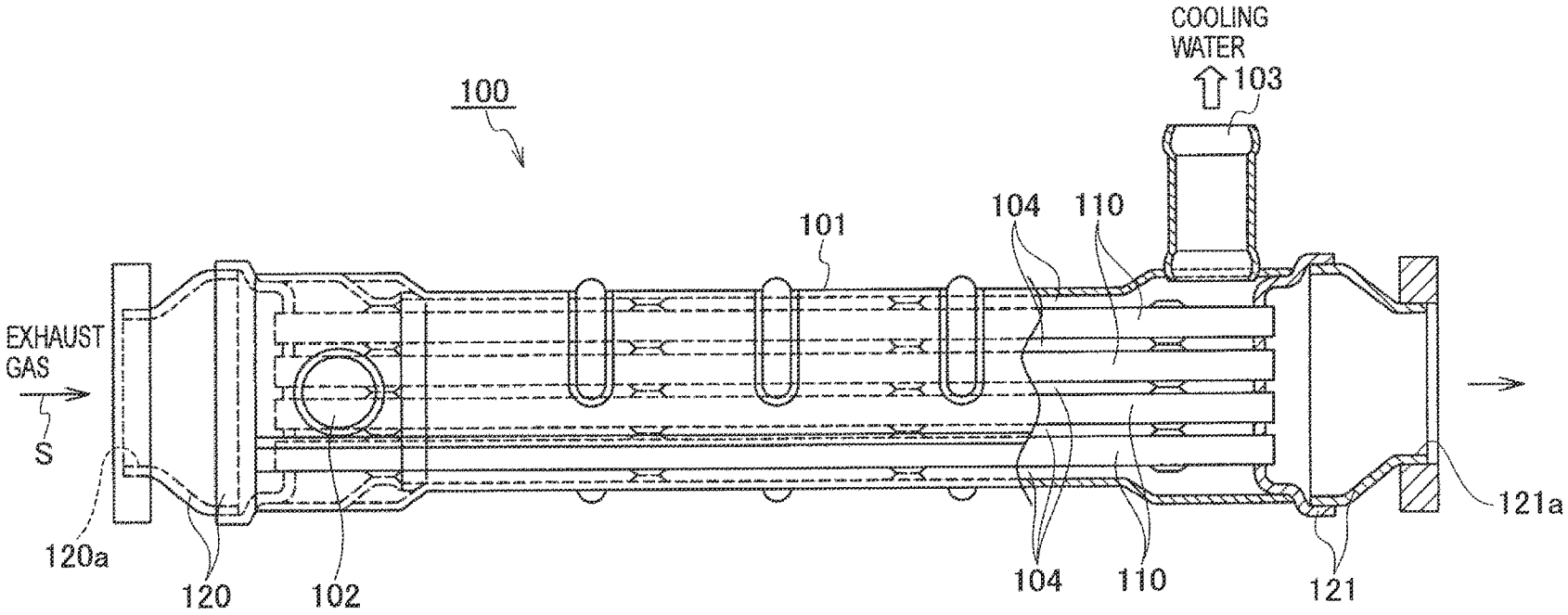
FIG. 25 is a partially-cutout front view of an exhaust-gas heat exchanging device of a conventional technique.
Figure 26:
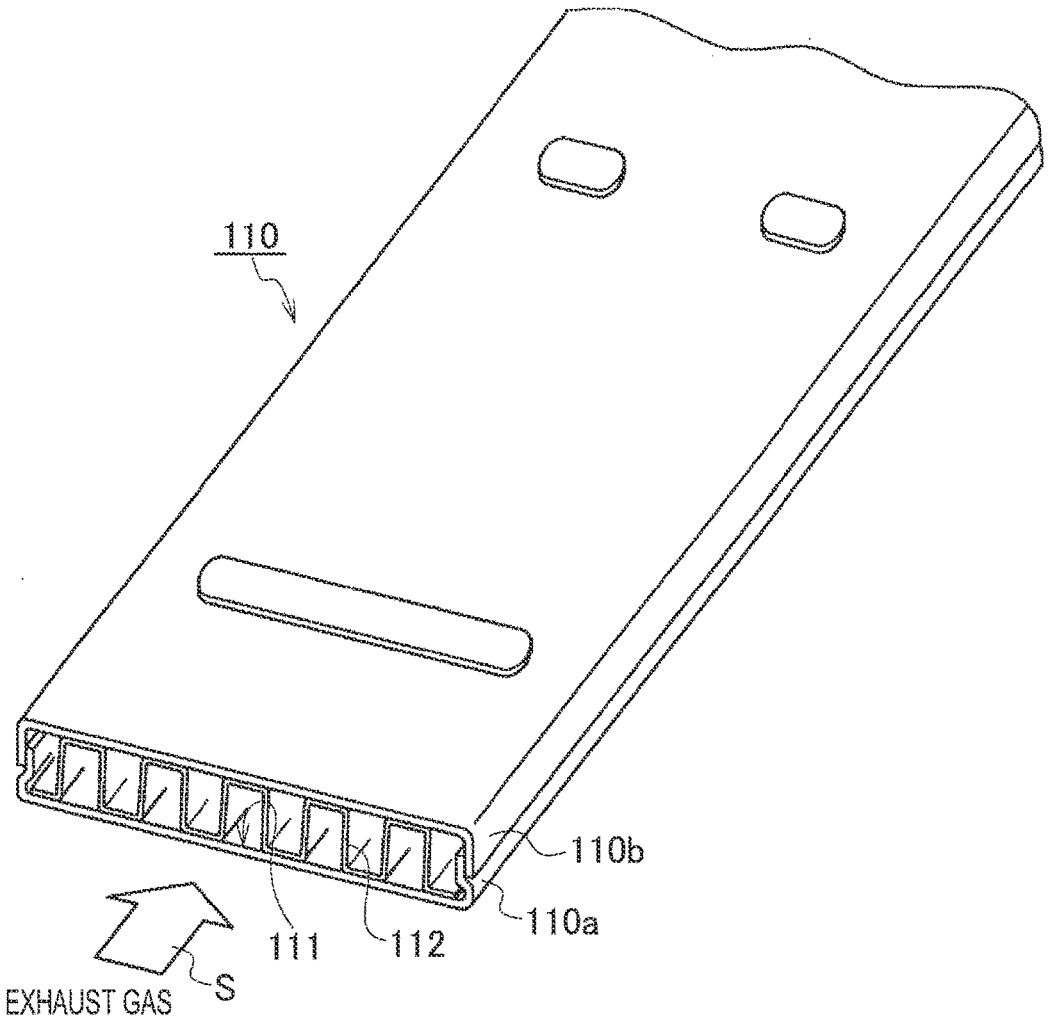
FIG. 26 is a perspective view of a tube in the exhaust-gas heat exchanging device in FIG. 25.
Figure 27:
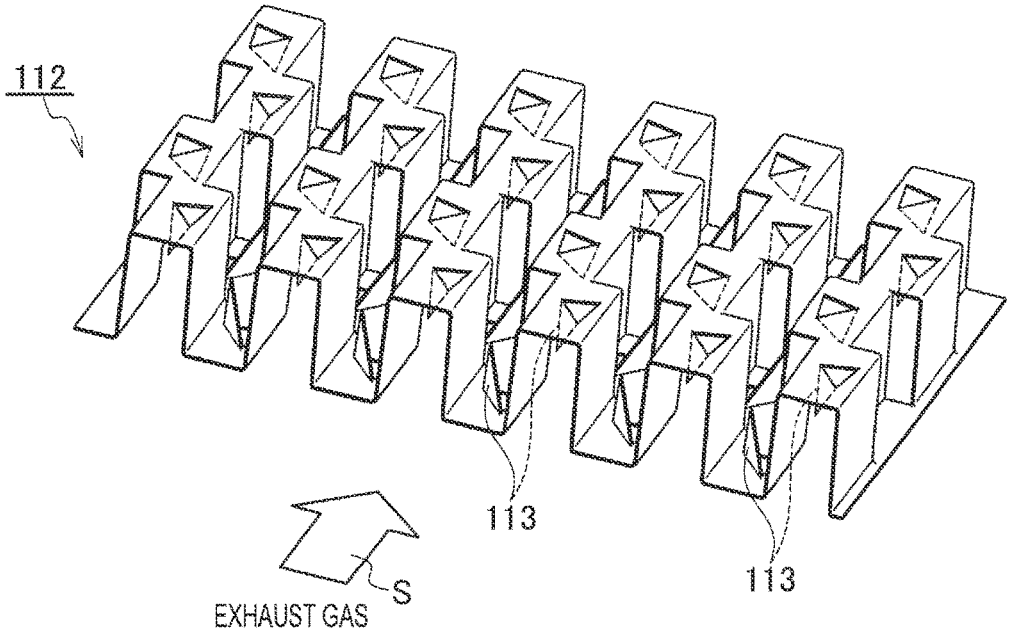
FIG. 27 is a perspective view of a fin in the in the exhaust-gas heat exchanging device in FIG. 25.
Figure 28:
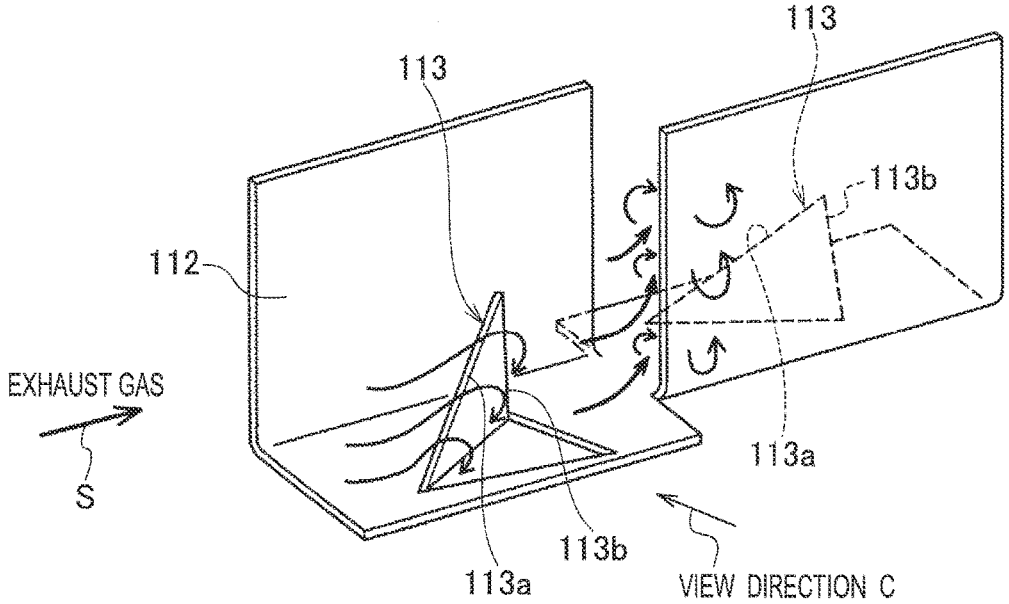
FIG. 28 is a perspective view of protruding pieces in the exhaust-gas heat exchanging device in FIG. 25.
Figure 29:
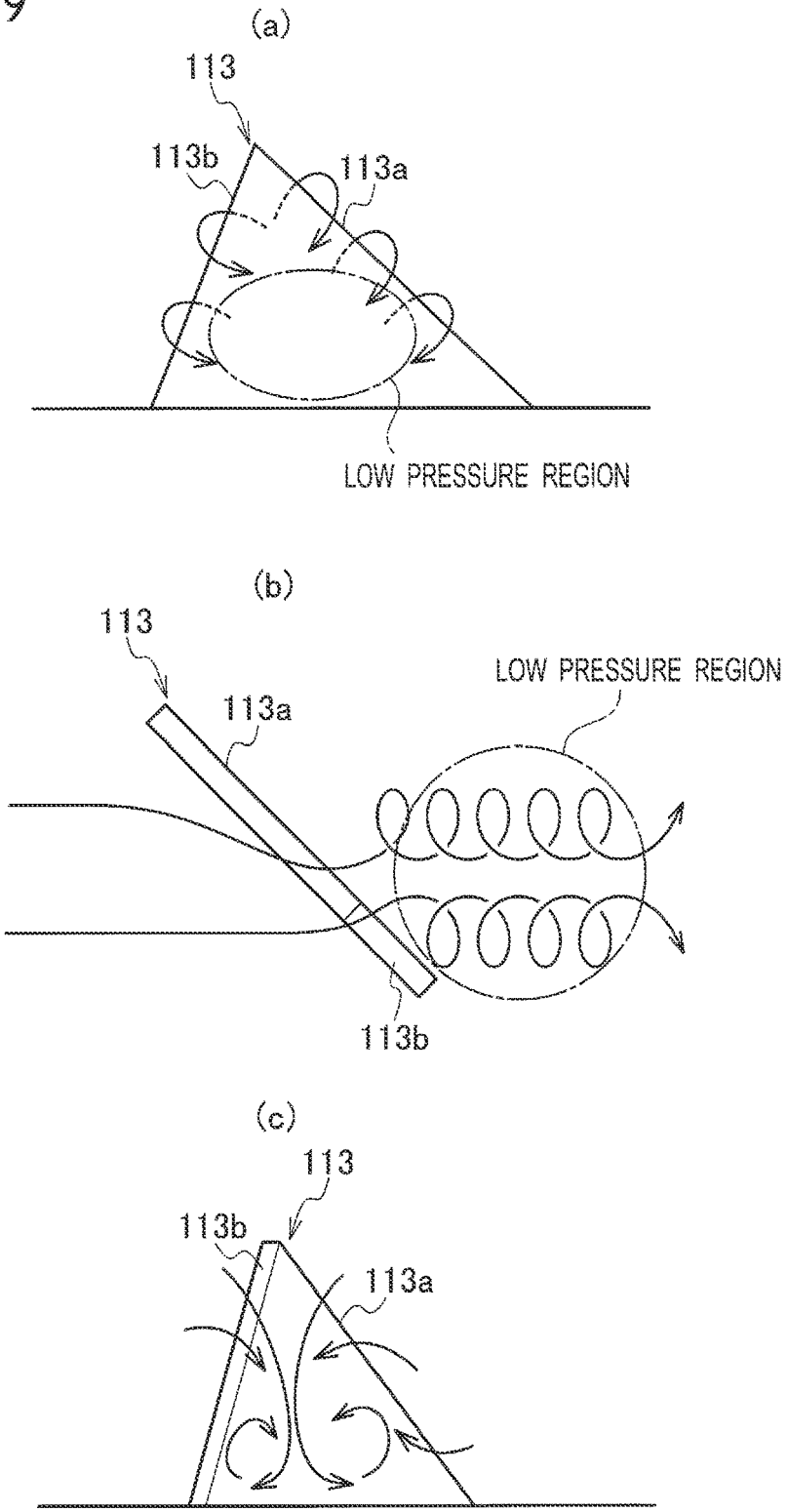
FIG. 29 shows a protruding piece in the exhaust-gas heat exchanging device in FIG. 25, and Part (a) is a view of the protruding piece as viewed from a direction C, Part (b) is a plan view of the protruding piece, and Part (c) is a view of vortexes formed downstream of the protruding piece as viewed from the downstream side of the protruding piece.

As shown in Parts (a) and (b) of FIG. 24, a center line CL of each segment 22 is preferably disposed to be shifted from the center CL of the segment 22 adjacent thereto in the exhaust-gas flow direction SD (e.g. the downstream segment 22) by 30 to 70% of the width W22 of one segment 22 in the perpendicular direction CD. In other words, the distance between the center lines CL of the two segments 22 adjacent in the exhaust-gas flow direction SD is preferably set to be 30 to 70% of the width W22 of one segment 22. In this way, the strength of the vortex is "1.25" or higher as compared to that in Example 1 (the strength of the vortex="1.00").

In particular, the center line CL of each segment 22 is preferably disposed to be shifted from the center CL of the segment 22 adjacent thereto in the exhaust-gas flow direction SD (e.g. the downstream segment 22) by 35 to 65% of the width W22 of one segment 22 with the center line CL of the segment 22 as a reference. In this way, the strength of the vortex is "1.30" or higher as compared to that in Example 1 (the strength of the vortex="1.00").

(Other Embodiments)

While the content of the present invention has been disclosed as above through the embodiment of the present invention, it should not be understood that the statement and the drawings constituting part of this disclosure limit this invention. Various alternative embodiments, examples, and operation techniques will become apparent to those skilled in the art from this disclosure.

For example, the embodiment of the present invention can be changed as follows. Specifically, the heat exchanger 1 has been described as an EGR cooler but is not limited to such a device and may be a heat exchanger configured to exchange heat between gas and coolant (e.g. a charge air cooler (CAC) or exhaust heat recovering device).

Also, the protruding pieces 25 have been described as being formed on the horizontal wall 23 of the segment 22 but are not limited to such a location and may be formed on a vertical wall 24 of the segment 22.

Also, the forward-tilting protruding piece 25A has been described as being trapezoidal but is not limited to such a shape and only needs to be in the shape of a four- or more-sided polygon that includes a base side in contact with the peripheral surface of the exhaust gas passage 20A and a pair of left and right sides. Note that the four- or more-sided polygon refers to a plane figure bounded by four or more line segments such as a quadrangle, pentagon, or hexagon. The same applies to the rearward-tilting protruding piece 25B. Specifically, the rearward-tilting protruding piece 25B has been described as being trapezoidal but is not limited to such a shape and only needs to be in the shape of a four- or more-sided polygon that includes a base side in contact with the peripheral surface of the exhaust gas passage 20A and a pair of left and right sides.

Also, the one of the sides 27A of the forward-tilting protruding piece 25A has been described as being shorter than the other of the sides 28A thereof but is not limited to such a dimension and may, for example, be as long as or slightly shorter than the other of the sides 28A.

Also, the top side 29A of the forward-tilting protruding piece 25A has been described as being inclined with respect to the base side 26A but is not limited to such a position and may be provided in parallel to the base side 26A.

Also, the segments 22 have been described as being formed in an offset pattern but are not limited to such a pattern and may simply repeat recesses and protrusions in the perpendicular direction CD.

Also, the angle a of the one of the sides 27A of the forward-tilting protruding piece 25A with respect to the base side 26A has been described as being equal to or larger than 90 degrees and the angle b of the other of the sides 28A of the forward-tilting protruding piece 25A with respect to the base side 26A has been described as being equal to or smaller than 90 degrees. However, the angles a, b are not limited to such degrees and may be set to any degrees as long as the angle a is larger than the angle b.

Also, the forward-tilting protruding pieces 25A in the segments 22 adjacent in the perpendicular direction CD have been described as being situated in the same orientation but are not limited to such arrangement and the forward-tilting protruding pieces 25A in the segments 22 adjacent in the perpendicular direction CD may be line-symmetric to each other.

Also, the forward-tilting protruding pieces 25A in the segments 22 adjacent in the exhaust-gas flow direction SD have been described as being line-symmetric to each other with respect to the perpendicular direction CD but are not limited to such arrangement and the forward-tilting protruding pieces 25A in the segments 22 adjacent in the exhaust-gas flow direction SD may be situated in the same orientation.

Also, the rearward-tilting protruding piece 25B has been described as being point-symmetric to the forward-tilting protruding piece 25A in the direction CD, which is perpendicular to the exhaust-gas flow direction SD and the tube stacking direction PD, but is not limited to such a shape and may be line-symmetric or asymmetric to the forward-tilting protruding piece 25A.

As described above, the present invention of course includes various embodiments and the like which are not described herein. Therefore, the technical scope of the present invention is determined solely by the matters specifying the invention according to the claims that are considered appropriate from the foregoing description.

This application claims priority to Japanese Patent Application No. 2013-090129 filed on Apr. 23, 2013 and Japanese Patent Application No. 2014-036638 filed on Feb. 27, 2014, the entire contents of which are incorporated herein by reference.

INDUSTRIAL APPLICABILITY

With the present invention, it is possible to obtain a heat exchanger which forms vortex flows that greatly promote the heat transfer and can therefore improve the heat exchange rate.

REFERENCE SIGNS LIST

1 heat exchanger
10 exterior case
11 cooling-water inlet
12 cooling-water outlet
13 cooling water passage (liquid passage)
20 tube
20A exhaust gas passage (gas passage)
21 fin
22 (22A to 22D) segment
25 protruding piece
25A forward-tilting protruding piece
26A base side
27A one of the sides
28A other of the sides
29A top side
25B rearward-tilting protruding piece
26B base side
27B one of the sides
28B other of the sides
29B top side

The invention claimed is:

1. A heat exchanger comprising:

a gas passage through which gas flows in a gas flow direction;

a forward-tilting protruding piece protruding into the gas passage and leaning toward an upstream side in the gas flow direction; and a rearward-tilting protruding piece protruding into the gas passage downstream of the forward-tilting protruding piece, the rearward-tilting protruding piece leaning toward a downstream side in the gas flow direction, wherein the forward-tilting protruding piece comprises a plate having a polygonal shape including a base side lying on an inner peripheral surface of the gas passage, the base side being oriented obliquely with respect to a first direction which is perpendicular to the gas flow direction and parallel to a base plane along the gas flow direction and the base side, the base side having a first end, and having a second end positioned on the downstream side in the gas flow direction of the first end;

a first side extending from the first end of the base side and forming a first internal angle with the base side;

a second side extending from the second end of the base side and forming a second internal angle with the base side, the second internal angle being smaller than the first internal angle as viewed in the gas flow direction; and a top side that is a farthest side from the base side and is a side other than the first side and other than the second side;

wherein the plate includes an upstream side surface having the polygonal shape and forming an acute angle with the base plane;

wherein the second side is longer than the first side;

wherein the first internal angle is larger than 90 degrees, and the second internal angle is equal to or smaller than 90 degrees, and wherein a ratio of a width of the forward-tilting protruding piece to a width of the gas passage is 40% to 80%.

2. The heat exchanger according to claim 1, further comprising:

a plurality of forward-tilting protruding pieces; and a plurality of rearward-tilting protruding pieces, wherein the gas passage is divided into segments arranged in the gas flow direction and in the first direction by a fin that is formed in such an offset pattern as to repeat recesses and protrusions in the first direction and to be staggered at a predetermined interval in the gas flow direction, and the segments are each provided with one of the plurality of the forward-tilting protruding pieces and one of the plurality of the rearward-tilting protruding pieces.

3. The heat exchanger according to claim 2, wherein each forward-tilting protruding piece respectively provided with each of the segments is formed on walls of the fin that are in proximate contact with a liquid passage through which liquid flows, and forward-tilting protruding pieces in each pair of segments that are adjacent in the first direction are situated in a same orientation as viewed in a second direction perpendicular to the base plane.

4. The heat exchanger according to claim 2, wherein each forward-tilting protruding piece respectively provided with each of the segments is formed on walls of the fin that are in proximate contact with a liquid passage through which liquid flows, and forward-tilting protruding pieces in each pair of segments that are adjacent in the gas flow direction are plane-symmetric to each other with respect to a plane perpendicular to the gas flow direction.

5. The heat exchanger according to claim 1, wherein a forward tilt angle of the forward-tilting protruding piece with respect to the base plane in a cross section parallel to the gas flow direction and perpendicular to the base plane is 40 to 50 degrees.

6. The heat exchanger according to claim 1, wherein an orientation angle of the base side with respect to the first direction is 35 to 60 degrees.

7. The heat exchanger according to claim 1, wherein the rearward-tilting protruding piece comprises a plate having a polygonal shape which includes a base side lying on the inner peripheral surface of the gas passage and having a third end, and having a fourth end positioned downstream of the third end, the first end and the third end are disposed on a straight line that is parallel to the gas flow direction, and the second end and the fourth end are disposed on a straight line that is parallel to the gas flow direction.

8. The heat exchanger according to claim 1, wherein the rearward-tilting protruding piece comprises a plate having a polygonal shape which includes a base side lying on the inner peripheral surface of the gas passage, and the base side of the forward-tilting protruding piece is parallel to the base side of the rearward-tilting protruding piece.

9. The heat exchanger according to claim 1, wherein the rearward-tilting protruding piece is point-symmetric to the forward-tilting protruding piece as viewed in a second direction perpendicular to the base plane.

10. A heat exchanger comprising:

a gas passage through which gas flows in a gas flow direction;

a forward-tilting protruding piece protruding into the gas passage and leaning toward an upstream side in the gas flow direction; and a rearward-tilting protruding piece protruding into the gas passage downstream of the forward-tilting protruding piece, the rearward-tilting protruding piece leaning toward a downstream side in the gas flow direction, wherein the forward-tilting protruding piece comprises a plate having a polygonal shape including a base side lying on an inner peripheral surface of the gas passage, the base side being oriented obliquely with respect to a first direction which is perpendicular to the gas flow direction and parallel to a base plane along the gas flow direction and the base side, the base side having a first end, and having a second end positioned on the downstream side in the gas flow direction of the first end;

a first side extending from the first end of the base side and forming a first internal angle with the base side;

a second side extending from the second end of the base side and forming a second internal angle with the base side, the second internal angle being smaller than the first internal angle as viewed in the gas flow direction; and a top side that is a farthest side from the base side and is a side other than the first side and other than the second side, the top side having a third end, and having a fourth end positioned closer to the second side than the third end as viewed in the gas flow direction, wherein the plate includes an upstream side surface having the polygonal shape and forming an acute angle with the base plane;

wherein the top side is inclined with respect to the base side such that the third end is closer to the base side than the fourth end as viewed in the gas flow direction;

wherein the second side is longer than the first side;

wherein the first internal angle is larger than 90 degrees, and the second internal angle is equal to or smaller than 90 degrees, and wherein a ratio of a width of the forward-tilting protruding piece to a width of the gas passage is 40% to 80%.

* * * * *